US010379452B2

(12) United States Patent
Ito et al.

(10) Patent No.: US 10,379,452 B2
(45) Date of Patent: Aug. 13, 2019

(54) COLOR IMAGE FORMING PROCESS AND COLOR TONER SET

(71) Applicant: Konica Minolta, Inc., Tokyo (JP)

(72) Inventors: Natsuki Ito, Hachioji (JP); Noboru Ueda, Mitaka (JP); Kouji Sugama, Musashino (JP); Kenshi Miyajima, Hino (JP); Yohei Ohno, Hino (JP); Hidehito Haruki, Asaka (JP); Keisuke Asano, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/948,020

(22) Filed: Apr. 9, 2018

(65) Prior Publication Data

US 2018/0307152 A1 Oct. 25, 2018

(30) Foreign Application Priority Data

Apr. 20, 2017 (JP) ..... 2017-083952

(51) Int. Cl.
*G03G 9/087* (2006.01)
*G03G 9/09* (2006.01)
*G03G 13/01* (2006.01)

(52) U.S. Cl.
CPC ..... *G03G 9/08755* (2013.01); *G03G 9/08711* (2013.01); *G03G 9/08795* (2013.01); *G03G 9/08797* (2013.01); *G03G 9/09* (2013.01); *G03G 9/0904* (2013.01); *G03G 9/0926* (2013.01); *G03G 13/013* (2013.01)

(58) Field of Classification Search
CPC ..... G03G 9/08755; G03G 9/08797; G03G 9/08711; G03G 9/0904; G03G 9/0926; G03G 13/013
USPC ..... 430/109.4, 107.1, 45.5, 45.51
See application file for complete search history.

(56) References Cited

U.S. PATENT DOCUMENTS

2006/0045571 A1* 3/2006 Matsuura ..... G03G 21/0064 399/149
2016/0246192 A1* 8/2016 Yoshida ..... G03G 9/0821

FOREIGN PATENT DOCUMENTS

JP 2008090054 A 4/2008
JP 2012078423 A 4/2012
JP 2016157104 A 9/2016

* cited by examiner

*Primary Examiner* — Janis L Dote
(74) *Attorney, Agent, or Firm* — Lucas & Mercanti, LLP

(57) ABSTRACT

Provided is a color image forming process using colorant-containing toners of multiple colors containing colorants respectively having different resistances, wherein each of the colorant-containing toners contains an amorphous resin, a crystalline polyester resin, and a mold release agent, at least the crystalline polyester resin contained in the colorant-containing toner other than the colorant-containing toner containing a colorant having the lowest resistance contains a hybrid crystalline polyester resin formed by bonding a crystalline polyester polymerized segment and an amorphous polymerized segment, and the content of the amorphous polymerized segment in the hybrid crystalline polyester resin contained in the colorant-containing toner other than the colorant-containing toner containing a colorant having the lowest resistance is greater than the content of the amorphous polymerized segment in the crystalline polyester resin contained in the colorant-containing toner containing a colorant having the lowest resistance.

10 Claims, 1 Drawing Sheet

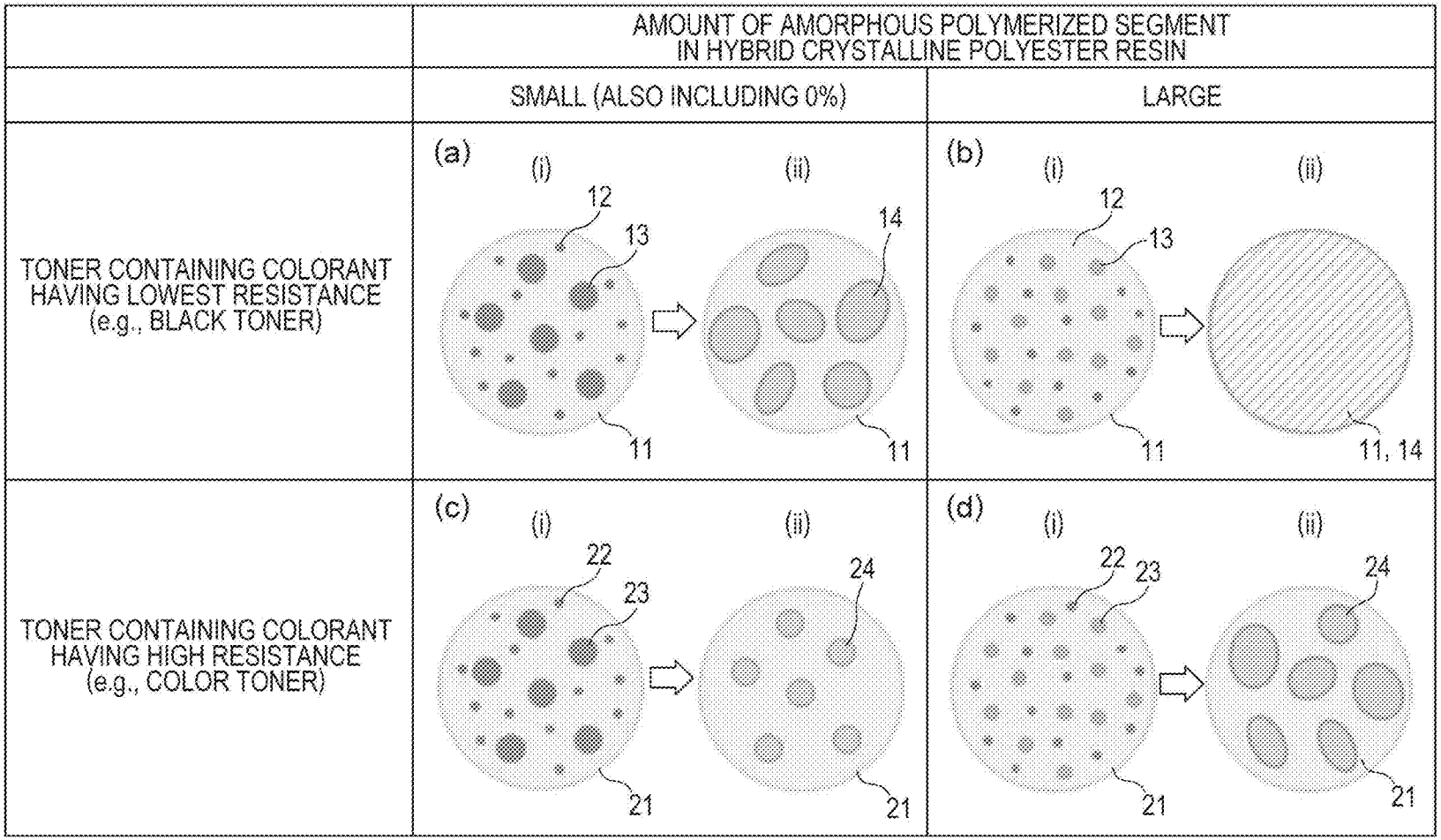
AMOUNT OF AMORPHOUS POLYMERIZED SEGMENT IN HYBRID CRYSTALLINE POLYESTER RESIN
SMALL (ALSO INCLUDING 0%)
LARGE
TONER CONTAINING COLORANT HAVING LOWEST RESISTANCE (e.g., BLACK TONER)
TONER CONTAINING COLORANT HAVING HIGH RESISTANCE (e.g., COLOR TONER)
(a)
(i)
(ii)
(b)
(i)
(ii)
(c)
(i)
(iii)
(d)
(i)
(iii)
11
12
13
14
11, 14
21
22
23
24

COLOR IMAGE FORMING PROCESS AND COLOR TONER SET

The entire disclosure of Japanese patent Application No. 2017-083952, filed on Apr. 20, 2017, is incorporated herein by reference in its entirety.

BACKGROUND

Technological Field

The present invention relates to a color image forming process and a color toner set.

Description of the Related Art

Increasing of speed and energy saving of copying machines have been desired since before, and thus the development of a toner for developing an electrostatic latent image (also simply referred to as a toner) having an excellent low temperature fixing property is proceeding. In such toner, decreasing of the melting temperature and melting viscosity of a binder resin is required, and a toner having a low temperature fixing property that has been improved by adding a crystalline resin such as a crystalline polyester resin has been suggested (JP 2012-078423 A and JP 2008-090054 A).

Crystalline polyester resins have low affinity to amorphous resins that account for the most of toners, and thus easily localize in the toners. Therefore, a hybrid crystalline polyester resin in which a part of a crystalline polyester resin contains an amorphous polymerized segment is used so that the crystalline polyester resin is easily taken into a toner. As a result, the toner is in a state that the hybrid crystalline polyester resin is dispersed in the toner (JP 2016-157104 A).

However, as described in JP 2012-078423 A and JP 2008-090054 A, a toner containing a crystalline polyester resin has a low electrical resistance (also abbreviated as resistance), and further, a black toner contains carbon black or the like, which has a low resistance, as a colorant, and thus has the lowest resistance in a color toner set. Therefore, there was a problem that a difference is generated in transfer properties between a black image and color images other than the black image during the transfer in the formation of a full-color image.

Furthermore, in JP 2016-157104 A, a resin having a polyester site and a polystyrene site is used in a crystalline polyester resin to allow the crystalline polyester resin to be enclosed, to aim at improving low temperature fixing property and hot offset resistance. However, since the amorphous polymerized segment in the crystalline polyester resin is of the same amount in color toners and a black toner, there was a problem that a difference is generated in transfer properties between a black image and color images during the transfer in the formation of a full-color image, and thus a full-color image having fine low temperature fixing property and fine transfer performance cannot be obtained.

SUMMARY

Therefore, an object of the present invention is to provide a color image forming process having fine low temperature fixing property and transfer performance, and a color toner set.

To achieve the abovementioned object, according to an aspect of the present invention, a color image forming process using colorant-containing toners of multiple colors containing colorants respectively having different resistances, reflecting one aspect of the present invention is provided, and in the process, each of the colorant-containing toners contains an amorphous resin, a crystalline polyester resin, and a mold release agent, at least the crystalline polyester resin contained in the colorant-containing toner other than the colorant-containing toner containing a colorant having the lowest resistance contains a hybrid crystalline polyester resin formed by bonding a crystalline polyester polymerized segment and an amorphous polymerized segment, and the content of the amorphous polymerized segment in the hybrid crystalline polyester resin contained in the colorant-containing toner other than the colorant-containing toner containing a colorant having the lowest resistance is greater than the content of the amorphous polymerized segment in the crystalline polyester resin contained in the colorant-containing toner containing a colorant having the lowest resistance.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention:

FIGURE is a drawing showing a toner containing a colorant having the lowest resistance (K) and a toner containing a colorant having a high resistance (YMC) according to an embodiment of the present invention, wherein (i) represents the embodiment of the size and distribution of the colorant and a hybrid resin in the toner, (ii) represents an image of a low-resistance part in the toner based on the above-mentioned (i), depending on the degree of the amount of an amorphous polymerized segment in a hybrid crystalline polyester resin (hybrid resin); (a) of FIGURE is a drawing of a case where the amount of the amorphous polymerized segment in the toner (K) is small; (b) of FIGURE is a drawing of a case where the amount of the amorphous polymerized segment in the toner (K) is large; (c) of FIGURE is a drawing of a case where the amount of the amorphous polymerized segment in the toner (YMC) is small; and (d) of FIGURE is a drawing of a case where the amount of the amorphous polymerized segment in the toner (YMC) is large.

DETAILED DESCRIPTION OF EMBODIMENTS

Hereinafter, one or more embodiments of the present invention will be described with reference to the drawings. However, the scope of the invention is not limited to the disclosed embodiments.

A first embodiment of the present invention is a color image forming process using colorant-containing toners of multiple colors containing colorants respectively having different resistances, wherein each of the colorant-containing toners contains an amorphous resin, a crystalline polyester resin and a mold release agent, at least the crystalline polyester resin contained in the colorant-containing toner other than the colorant-containing toner containing a colorant having the lowest resistance (hereinafter, also referred to simply as "colorant-containing toner having the lowest resistance") contains a hybrid crystalline polyester resin formed by bonding a crystalline polyester polymerized segment and an amorphous polymerized segment, and the content of the amorphous polymerized segment in the hybrid crystalline polyester resin contained in the colorant-containing toner other than the colorant-containing toner containing a colorant having the lowest resistance is greater than the content of the amorphous polymerized segment in the crystalline polyester resin contained in the colorant-containing toner containing a colorant having the lowest resistance.

Furthermore, a second embodiment of the present invention is a color toner set having at least four kinds of toners of a yellow toner, a magenta toner, a cyan toner, and a black toner as colorant-containing toners having multiple colors containing colorants having respectively different resistances, wherein each of the four kinds of toners contains an amorphous resin, a crystalline polyester resin and a mold release agent, at least the crystalline polyester resin contained in each of the yellow toner, the magenta toner, and the cyan toner which are the colorant-containing toners other than the colorant-containing toner containing a colorant having the lowest resistance contains a hybrid crystalline polyester resin formed by bonding a crystalline polyester polymerized segment and an amorphous polymerized segment, and the content of the amorphous polymerized segment in the hybrid crystalline polyester resin contained in each of the yellow toner, the magenta toner, and the cyan toner as the colorant-containing toners other than the colorant-containing toner containing a colorant having the lowest resistance is greater than the content of the amorphous polymerized segment in the crystalline polyester resin contained in the black toner as a colorant-containing toner containing a colorant having the lowest resistance.

The toner set as used herein refers to a combination of toners that form different image formation layers when they are transferred onto a recording medium.

According to the color image forming process and the color toner set of the present invention, a full-color image in which a difference is difficult to generate in the transfer property of a multiple-color image during the transfer in the formation of the full-color image while fine low temperature fixing property is maintained, and thus a full-color image having a fine transfer performance can be obtained. The mechanism of action from which the above-mentioned effect can be obtained by such the constitution of the present invention (mechanism of action or mechanism of expression) is unclear, but it can be considered as follows.

FIGURE is a drawing showing a toner containing a colorant having the lowest resistance (e.g., black toner; K) and a toner containing a colorant having a high resistance other than the toner containing a colorant having the lowest resistance (e.g., color toners; YMC), wherein (i) is schematic representation of the embodiment of the size and distribution of the colorant (particles) and the hybrid resin (particles) in the toner, (ii) is schematic representation of an image of a low-resistance part in the toner based on the above-mentioned (i), depending on the degree of the amount of an amorphous polymerized segment in a hybrid crystalline polyester resin (hybrid resin). (a) of FIGURE is a drawing of the above-mentioned (i) and (ii) in a case where the content of the amorphous polymerized segment in the hybrid resin in the toner (K) is small. (b) of FIGURE is a drawing of the above-mentioned (i) and (ii) in a case where the content of the amorphous polymerized segment in the hybrid resin in the toner (K) is large. (c) of FIGURE is a drawing of the above-mentioned (i) and (ii) in a case where the content of the amorphous polymerized segment in the hybrid resin in the toner (YMC) is small. (d) of FIGURE is a drawing of the above-mentioned (i) and (ii) in a case where the content of the amorphous polymerized segment in the hybrid resin in the toner (YMC) is large.

It is recognized that, as shown in (b) of FIGURE, the toner containing a colorant having the lowest resistance 11 as represented by carbon black contains a low-resistance carbon black (colorant particles) 12 and low-resistance (hybrid) crystalline polyester resin particles 13 that are fine and are present approximately homogeneously in the toner 11, and thus the resistance of the entirety of the toner 11 is low (an image in which the entirety of the toner 11 is a low-resistance part 14; see (b) (ii) of FIGURE).

On the other hand, as shown in (d) of FIGURE, a toner containing a colorant having a high resistance 21 such as an organic pigment (a color colorant 22) has a higher resistance than that of the toner containing a colorant having the lowest resistance even if a (hybrid) crystalline polyester resin having a low resistance 23 is added by an equivalent amount to that of the toner containing a colorant having the lowest resistance. That is, it is presumed that, since the color colorant particles having a high resistance 22 and the (hybrid) crystalline polyester resin particles having a low resistance 23 are made fine and present by being dispersed in the toner 21, the color colorant particles 22 and the (hybrid) crystalline polyester resin particles 23 are in a state that they are slightly localized with suppressing the dispersion of a crystalline polyester resin having a low resistance (a low-resistance part 24), and relatively large low-resistance parts 24 are localized in the toner 21 and thus the toner 21 has a higher resistance than that of the toner containing a colorant having the lowest resistance. It is presumed that, for this reason, a difference has occurred in the transfer property between the toner containing a colorant having the lowest resistance and the toner containing a colorant having a high resistance.

It is presumed that a similar phenomenon occurs also between the toner containing a colorant having the lowest resistance 11 shown in (a) of FIGURE and the toner containing a colorant having a high resistance 21 shown in (c) of FIGURE. That is, it is presumed that the toner containing a colorant having a high resistance 21 has a higher resistance than that of the toner containing a colorant having the lowest resistance 11 also between the toner containing a colorant having the lowest resistance 11 shown in (a) of FIGURE and the toner containing a colorant having a high resistance 21 shown in (c) of FIGURE, which are toners 21 containing the colorant 22 having a high resistance to which the low-resistance (hybrid) crystalline polyester resin 13 or 23 is added at an equivalent amount to that of the toner 11 containing the colorant having the lowest resistance 12 (however, the images of the low-resistance parts 14 and 24 in the toners 11 and 21 are different between (b), (d) of FIGURE and (a), (c) of FIGURE, but are common in that the toner containing a colorant having a high resistance has a higher resistance than that of the toner containing a colorant having the lowest resistance). It is presumed that, for this reason, a difference has generated in the transfer property between the toner containing a colorant having the lowest resistance and the toner containing a colorant having a high resistance.

The reason why a difference has occurred in the transfer property between the toner containing a colorant having the lowest resistance and the toner containing a colorant having a high resistance by setting the amount of the (hybrid)

crystalline polyester resin (and the amorphous polymerized segment in the resin) to be equivalent in the toner containing a colorant having a high resistance and in the toner containing a colorant having the lowest resistance as follows. That is, it is presumed that, in a transfer step, a toner that has been attached to an intermediate transfer body by charging is transferred by being adsorbed onto a paper sheet by an electrostatic attractive force with an electrical charge on a rear surface of the paper sheet, and discharging occurs under a high temperature-high humidity environment and thus the transfer property of the toner containing a colorant having the lowest resistance is lowered. More specifically, a toner containing a crystalline polyester resin is excellent in low temperature fixing property. However, a crystalline polyester resin also has an aspect that it has a low electrical resistance, and thus lowers the charging property of the toner when it is used as a binder resin for the toner. From such a viewpoint, it is presumed that the toner containing a colorant having the lowest resistance contains carbon black or the like used as a colorant, which has a low resistance (i.e., a high electroconductivity), and thus cannot maintain an insulation property during application of an electric field during transfer, and thus the transfer property is easily lowered. Furthermore, it is presumed that such decrease in transfer property easily occurs specifically under a high temperature-high humidity environment in which a charging property tends to be low.

Therefore, the present invention has focused on a (hybrid) crystalline polyester resin to be added to a toner containing a colorant having the lowest resistance and a toner containing a colorant having a high resistance, and has preset the amount of an amorphous polymerized segment in the hybrid crystalline polyester resin to be larger in the toner containing a colorant having a high resistance than in the toner containing a colorant having the lowest resistance (see the combination of (a) and (d) of FIGURE) to thereby exert the above-mentioned effect of the invention.

As shown in (a) of FIGURE, the amount of the amorphous polymerized segment in the hybrid crystalline polyester resin is adjusted to be smaller in the toner containing a colorant having the lowest resistance than in the toner containing a colorant having a high resistance (see (a) (i) of FIGURE) to thereby suppress the dispersibility of the low-resistance crystalline polyester resin in the toner (see the low-resistance part image in (a) (ii) of FIGURE) to put the toner in a state that the resistance is increased.

On the other hand, as shown in (d) of FIGURE, since the amount of the amorphous polymerized segment in the hybrid crystalline polyester resin was adjusted to be larger in the toner containing a colorant having a high resistance than in the toner containing a colorant having the lowest resistance (see (d) (i) of FIGURE), it is presumed that the dispersibility of the low-resistance crystalline polyester resin in the toner was improved (see the image of the low-resistance part in (d) (ii) of FIGURE) to put the toner in a state that the resistance is decreased, whereby the balance of resistance between the toner containing a colorant having the lowest resistance and the toner containing a colorant having a high resistance was able to be adjusted.

That is, by adjusting the content of the amorphous polymerized segment in the toner containing a colorant having a high resistance (an organic pigment or the like) to be larger than in the toner containing a colorant having the lowest resistance, the crystalline polyester resin having the lowest resistance in the binder resin can be dispersed in the toner particles, thereby the resistance can be decreased. Conversely, by adjusting the content of the amorphous polymerized segment in the toner containing the colorant having the lowest resistance (black toner) to be smaller than in the toner containing a colorant having a high resistance, the dispersion of the crystalline polyester resin having the lowest resistance is suppressed and the crystalline polyester resin is put into a slightly localized state in the binder resin, and thus the resistance can be increased. Since it is sufficient that the content of the amorphous polymerized segment is smaller in the toner containing the colorant having the lowest resistance than in the toner containing a colorant having a high resistance, the content may also be 0% by mass. Meanwhile, that the content of the amorphous polymerized segment is 0% by mass with respect to the whole amount of the hybrid crystalline polyester resin corresponds to a case where the toner does not contain any hybrid crystalline polyester resin (in a case of only a non-hybrid crystalline polyester resin).

It is presumed that the reason why a fine transfer property can be obtained by adjusting the balance of resistance between the toner containing a colorant having the lowest resistance and the toner containing a colorant having a high resistance in such way is as follows. Specifically, the resistance value is increased by decreasing the amount of the amorphous polymerized segment in the toner containing a colorant having the lowest resistance, but there is a difference in resistance value from the toner containing a colorant having a high resistance also in a case of only a non-hybrid crystalline polyester resin, and thus a transfer property under a high temperature-high humidity environment cannot be improved. Therefore, it is presumed that a fine transfer property can be possessed under every environment by also decreasing the resistance value of the toner containing a colorant having a high resistance. It is presumed that a full-color image in which a difference is difficult to occur in the transfer property between a black image and color images during the transfer in the formation of a full-color image while a fine low temperature fixing property is maintained, and which has a fine transfer performance, can be obtained.

By the above-mentioned mechanism of action, according to the color image forming process and the color toner set of the present invention, a full-color image having a fine low temperature fixing property and a fine transfer performance can be obtained.

The above-mentioned mechanism of action is made by presumption, and thus the present invention is not limited at all by the above-mentioned mechanism of action.

The embodiments for carrying out the present invention will be explained in detail. The present invention is not limited to only the following embodiments. Furthermore, in the present specification, "X to Y" representing a range encompasses X and Y and means "X or more to Y or less". Furthermore, unless otherwise stated, the operations and the measurement of physical properties and the like were conducted under a condition at room temperature (25° C.)/a relative humidity of 40 to 50% RH.

The color image forming process and the color toner set for developing an electrostatic latent image of the present invention have features in the respective toners as mentioned above. Therefore, firstly, the constitutions of the respective toners (toners containing colorants having different resistances) will be explained below in detail.

<Toners Containing Colorants of Respective Colors (Toners for Developing Electrostatic Latent Images)>

The toners containing colorants of respective colors having different colorant resistances (a toner containing a colorant having the lowest resistance (a black toner) and toners other than the toner containing a colorant having the lowest resistance (respective color toners) in the present invention each contain an amorphous resin, a crystalline polyester resin, a colorant corresponding to each color, and a mold release agent. The "toner" in the present invention refers to an aggregate of "toner particles".

[Toner Particles]

The toner particles that constitute the colorant-containing toner in the present invention contain an amorphous resin, a crystalline polyester resin, a colorant corresponding to each color, and a mold release agent. Furthermore, the toner particles may also contain other toner constitutional components such as a charge controlling agent as necessary. The respective components that constitute the toner particles are explained below.

<<Crystalline Polyester Resin>>

The toner particles contain a crystalline polyester resin as a binder resin. Therefore, the crystalline polyester resin and the amorphous resin are compatible during heating fixation, and thus the low temperature fixing property of the toner can be improved. Furthermore, the crystalline polyester resin contained in the colorant-containing toner other than the colorant-containing toner containing a colorant having the lowest resistance contains a hybrid crystalline polyester resin formed by bonding a crystalline polyester polymerized segment and an amorphous polymerized segment. By incorporating the crystalline polyester resin as a binder resin in the toner particles, the sharp melt property of the toner particles can be improved, and thus the low temperature fixing property and the fixing-separation property can be made fine.

The crystalline polyester resin (including the hybrid crystalline polyester resin) refers to a polyester resin that has not a stepwise endothermic change but a clear endothermic peak in differential scanning calorimetry (DSC). The clear endothermic peak specifically refers to a peak having a half width of an endothermic peak within 15° C. when the crystalline polyester resin is measured at a temperature raising speed of 10° C./min in differential scanning calorimetry (DSC).

The melting point (Tc) of the crystalline polyester resin (including a hybrid crystalline polyester resin) is preferably 55 to 90° C., and more preferably 70 to 88° C. If the melting point of the crystalline polyester resin is within a range of 55 to 90° C., a sufficient low temperature fixing property can be obtained. The melting point of the crystalline polyester resin can be controlled by a resin composition. The melting point (Tc) of the crystalline polyester resin can be measured by differential scanning calorimeter (DSC), and is specifically measured by the process described in Examples. Furthermore, the above-mentioned melting point can be controlled by any person skilled in the art by the composition of the resin.

In the colorant-containing toners having respective colors in the present invention, at least the crystalline polyester in the toners each containing a colorant having a high resistance other than the toner containing a colorant having the lowest resistance each contain a hybrid crystalline polyester resin in which a crystalline polyester polymerized segment and an amorphous polymerized segment are bonded. The reason why "at least" is described is that the toner containing a colorant having the lowest resistance may also contain the above-mentioned hybrid crystalline polyester resin as necessary (see Examples 3, 4 and 9).

As the above-mentioned toner containing a colorant having the lowest resistance, a black toner is preferable. This is because a black colorant used in a black toner (K) contains much carbon black and has a low resistance, and thus the black colorant is useful in forming a full-color image. On the other hand, as the toners each containing a colorant having a high resistance other than the toner containing a colorant having the lowest resistance, color toners each containing a yellow toner (Y), a magenta toner (M), and a cyan toner (C) are preferable. This is because either of the yellow, magenta, and cyan colorants used in the color toner (YMC) contains much organic pigment and has a high resistance, and thus is useful in forming a full-color image. That is, as the toners containing colorants of respective colors, a constitution having four kinds of toners: a yellow toner (Y), a magenta toner (M), a cyan toner (C), and a black toner (K) that are useful for forming a full-color image is preferable.

Furthermore, the toners containing colorants of respective colors in the present invention are characterized by that the content of the amorphous polymerized segment in the hybrid crystalline polyester resin is larger in the content in the colorant-containing toner other than the colorant-containing toner containing a colorant having the lowest resistance than in the content in the toner containing a colorant having the lowest resistance. In a constitution having four kinds of toners: a yellow toner (Y), a magenta toner (M), a cyan toner (C), and a black toner (K), the content of the amorphous polymerized segment in the hybrid crystalline polyester resin is larger in the contents in the three kind of toners: the yellow toner (Y), the magenta toner (M), and the cyan toner (C), which respectively contain yellow, magenta, and cyan colorants having high resistances, than the content in the black toner (K) containing a black colorant having the lowest resistance.

Here, the content of the amorphous polymerized segment in the crystalline polyester resin contained in the colorant-containing toner containing a colorant having the lowest resistance is preferably in the range of 0 to 20% by mass, more preferably in the range of 0 to 10% by mass, further preferably in the range of 0 to 5% by mass, and specifically preferably in the range of 0 to 1% by mass with respect to the whole amount of the crystalline polyester resin. When the content of the amorphous polymerized segment contained in the colorant-containing toner containing a colorant having the lowest resistance (the black toner (K)) is 20% by mass or less, the crystalline polyester resin is suitably dispersed in the toner, and lowering of the resistance can be effectively suppressed, whereby a fine full-color image can be formed. Furthermore, a fine low temperature fixing property can also be maintained. When the above-mentioned content is 10% by mass or less, the above-mentioned tendency (effect) can be obtained more significantly, when the above-mentioned content is 5% by mass or less, the above-mentioned tendency (effect) can be obtained further significantly, and when the above-mentioned content is 1% by mass or less, the above-mentioned tendency (effect) can be obtained specifically significantly.

Either of the respective contents of the amorphous polymerized segment in the hybrid crystalline polyester resin contained by the toners containing colorants other than the colorant-containing toner containing a colorant having the lowest resistance (preferably, the color toners YMC) is preferably in the range of 1 to 25% by mass, more preferably in the range of 1 to 20% by mass, and further preferably in the range of 3 to 10% by mass with respect to the whole amount of the hybrid crystalline polyester resin. If each content of the amorphous polymerized segment contained in the toner having each color colorant having a high resistance (the color toners YMC) is 1% by mass or more, the compatibility with the amorphous resin when the toner is melted is fine, and thus the low temperature fixing property is excellent. Furthermore, the crystalline polyester resin is prevented from localizing in the toner, and increase in the resistance can be effectively suppressed, whereby an excellent full-color image can be formed. When each content of the amorphous polymerized segment contained in each color colorant-containing toner having a high resistance (the color toners YMC) is 3% by mass or more, the above-mentioned tendency (effect) can be obtained more significantly. On the other hand, when the above-mentioned content is 25% by mass or less, the amount of the crystalline polyester in the toner becomes a suitable amount, and the low temperature fixing property becomes excellent. The crystalline polyester resin having the lowest resistance can be dispersed in the toner particles, the resistance can be lowered, and a fine full-color image can be obtained. When the above-mentioned content is 20% by mass or less, the above-mentioned tendency (effect) is obtained more significantly, whereas when the content is 10% by mass or less, the above-mentioned tendency (effect) can be obtained specifically significantly.

When the content of the amorphous polymerized segment in the hybrid crystalline polyester resin contained in the colorant-containing toner (having a high resistance) other than the colorant-containing toner containing a colorant having the lowest resistance is set as a, and the content of the amorphous polymerized segment in the above-mentioned crystalline polyester resin contained in the toner containing a colorant having the lowest resistance is set as b, it is more preferable that a and b satisfy the following Formula (3), preferably Formula (2), and more preferably Formula (1). All of the units of the contents a and b and the numerical values in the following Formulas (1) to (3) are based on % by mass.

[Mathematical Formula 2]

$$1 \leq (a-b) \leq 25 \quad \text{Formula (3)}$$

$$1 \leq (a-b) \leq 20 \quad \text{Formula (2)}$$

$$3 \leq (a-b) \leq 10 \quad \text{Formula (1)}$$

By satisfying the above-mentioned Formula (3), preferably Formula (2), and more preferably Formula (1), a balance of performance between the above-mentioned toner containing a colorant having a high resistance and the colorant-containing toner containing a colorant having the lowest resistance can be achieved. When $1 \leq (a-b)$ in the above-mentioned Formulas (3) and (2), the difference between the resistance of the toner containing a colorant having a high resistance and the resistance of the toner containing a colorant having the lowest resistance can be decreased, and thus the balance of resistance between these toners can be finely adjusted. Therefore, a fine full-color image can be obtained. Furthermore, when $3 \leq (a-b)$ in the above-mentioned Formula (1), the above-mentioned tendency (effect) can be obtained more significantly. On the other hand, when $(a-b) \leq 25$ in the above-mentioned Formula (3), a balance between the resistance of the toner containing a colorant having a high resistance and the resistance of the toner containing a colorant having the lowest resistance becomes excellent (a state that the difference in resistances is smaller), and thus a finer full-color image can be obtained. Furthermore, when $(a-b) \leq 20$ in the above-mentioned Formula (2), the above-mentioned tendency (effect) can be obtained more significantly, and when $(a-b) \leq 10$ in the above-mentioned Formula (1), the above-mentioned tendency (effect) can be obtained specifically significantly.

It is preferable that the amorphous polymerized segment contained in the hybrid crystalline polyester resin is constituted by a resin of the same kind as at least one kind of the amorphous resin in the toner. This is because a fine low temperature fixing property and a full-color image can be obtained. When the resin of the amorphous polymerized segment in the hybrid crystalline polyester is the same resin as at least one kind of the amorphous resin in the toner, the compatibility when the toner is melted and the dispersibility of the crystalline polyester resin in the toner are improved.

The amorphous polymerized segment contained in the hybrid crystalline polyester resin is preferably a styrene-acrylic polymerized segment. Since the styrene-acrylic polymerized segment contains a small number of functional groups and has low hygroscopicity, the transfer property thereof under a high temperature and a high humidity becomes better than that of the amorphous polyester polymerized segment.

In the present invention, the colorant-containing toners each contain, an amorphous resin as a binder resin besides the crystalline polyester resin (including the hybrid crystalline polyester resin). The content of the crystalline polyester resin in the colorant-containing toner is preferably 1 to 30% by mass, more preferably 3 to 20% by mass, and specifically preferably 5 to 15% by mass with respect to the entirety of the binder resin. When the content of the crystalline polyester resin is 1% by mass or more, the crystalline polyester resin is appropriately plasticized by compatibility with the amorphous resin, and thus the low temperature fixing property is improved. On the other hand, when the content of the crystalline polyester resin is 30% by mass or less, the plasticization is appropriately suppressed, and a fine transfer property can be obtained even under a high temperature-high humidity environment. Furthermore, the resistance of the toner containing a colorant having a high resistance can be increased, and a fine full-color image can be obtained.

Furthermore, from the viewpoint of similarly obtaining improvement of a low temperature fixing property and a fine transfer property, the content of the crystalline polyester resin (including the hybrid crystalline polyester resin) in the colorant-containing toner is preferably 1 to 30% by mass, more preferably 3 to 20% by mass, and specifically preferably 5 to 15% by mass with respect to the total mass of the crystalline polyester resin, the amorphous resin, and the mold release agent in total. When the content of the crystalline polyester resin is 1% by mass or more, the toner is appropriately plasticized by compatibility with the amorphous resin, and thus the low temperature fixing property is easily improved. When the content of the crystalline polyester resin is 5% by mass or more, a finer low temperature fixing property can be obtained. On the other hand, when the content of the crystalline polyester resin is 30% by mass or less, plasticization is appropriately suppressed, and thus fine transfer property can be obtained even under a high temperature-high humidity environment. Furthermore, the resistance of the toner containing a colorant having a high resistance can be increased, and thus a fine full-color image can be obtained. When the content of the crystalline polyester resin is 15% by mass or less, a finer transfer property can be obtained, and thus a finer full-color image can be obtained.

The structures of the constitutional components (constitutional units) of the above-mentioned crystalline polyester resin (including the hybrid crystalline polyester resin), and the content (ratio) of each constitutional component (each constitutional unit, each polymerized segment, or the like)

can be specified by, for example, an NMR measurement or a methylation reaction Py-GC/MS measurement.

Hereinafter the crystalline polyester resin that is not hybrid (containing no amorphous polymerized segment) and the hybrid crystalline polyester resin will be separately explained.

[Crystalline Polyester Resin that is not Hybrid]

In this item, "a crystalline polyester resin that is not hybrid" is also referred to as "a non-hybrid crystalline polyester resin".

The non-hybrid crystalline polyester resin can be obtained by a polycondensation reaction of a bi- or more valent carboxylic acid (a polycarboxylic acid) and a bi- or more valent alcohol (a polyalcohol).

(Polycarboxylic Acid)

The polycarboxylic acid used for the preparation of the non-hybrid crystalline polyester resin may be any compound having two or more carboxy groups in one molecule which can form a crystalline resin by a polycondensation reaction.

Specific examples include saturated aliphatic dicarboxylic acids such as oxalic acid, malonic acid, succinic acid, adipic acid, pimelic acid, sebacic acid, azelaic acid, n-dodecylsuccinic acid, 1,9-nonanedicarboxylic acid, 1,10-decanedicarboxylic acid, 1,11-undecanedicarboxylic acid, 1,12-dodecanedicarboxylic acid (tetradecane diacid), 1,13-tridecanedicarboxylic acid, and 1,14-tetradecanedicarboxylic acid; alicyclic dicarboxylic acids such as cyclohexanedicarboxylic acid; aromatic dicarboxylic acids such as phthalic acid, isophthalic acid, and telephthalic acid; tri- or more valent polycarboxylic acids such as trimellitic acid and pyromellitic acid; and anhydrides or esters with an alkyl having 1 to 3 carbon atom(s) of these carboxylic acid compounds. These may be used by solely one kind, or in combination of two or more kinds.

(Polyalcohol)

The polyalcohol used for the preparation of the non-hybrid crystalline polyester resin may be any compound having two or more hydroxy groups in one molecule which can form a crystalline resin by a polycondensation reaction.

Specific examples include aliphatic diols such as 1,2-propanediol, 1,3-propanediol, 1,4-butanediol, 1,5-pentandiol, 1,6-hexanediol, 1,7-heptanediol, 1,8-octandiol, neopentyl glycol, and 1,4-butenediol; tri- or more valent polyalcohols such as glycerin, pentaerythritol, trimethylolpropane, and sorbitol; and the like. These may be used by solely one kind, or in combination of two or more kinds.

(Melting Point of Non-Hybrid Crystalline Polyester Resin)

The melting point of the non-hybrid crystalline polyester resin is preferably in the range of 60 to 90° C., and more preferably in the range of 70 to 85° C., from the viewpoint that a sufficient low temperature fixing property can be obtained. The melting point of the crystalline polyester resin can be controlled by the resin composition.

The melting point of the non-hybrid crystalline polyester resin indicates the temperature of the peak top of the endothermic peak, and is a value obtained by a DSC measurement by differential scanning calorimetry by using "Diamond DSC" (manufactured by Perkin Elmer). Specifically, 1.0 mg of a measurement sample (a non-hybrid crystalline polyester resin) is enclosed in an aluminum pan (KITNO. B0143013), this pan is set in a sample holder of "Diamond DSC", the temperature is controlled by heating-cooling-heating under measurement conditions of a measurement temperature of 0 to 200° C., a temperature raising speed of 10° C./min, a temperature lowering speed of 10° C./min, and the melting point is analyzed based on the data at the second heating. The melting point of the hybrid crystalline polyester resin can also be similarly measured.

(Weight Average Molecular Weight and Number Average Molecular Weight of Non-hybrid Crystalline Polyester Resin)

The weight average molecular weight (Mw) of the non-hybrid crystalline polyester resin is not specifically limited, and is preferably in the range of 5,000 to 100,000, and more preferably in the range of 5,000 to 50,000. When the above-mentioned weight average molecular weight (Mw) is 5,000 or more, the heat-resistant retention property of the toner can be improved, whereas when the weight average molecular weight is 100,000 or less, the low temperature fixing property can further be improved. The number average molecular weight (Mn) of the resin is not specifically limited, and is preferably in the range of 1,000 to 25,000, and more preferably in the range of 3,000 to 20,000. Such range is preferable in view of low temperature fixing property and glossiness stability. The above-mentioned weight average molecular weight (Mw) and the number average molecular weight (Mn) can be measured by gel permeation chromatography (GPC). Specifically, these molecular weights can be measured by the following process.

(Process for measuring Weight Average Molecular Weight and Number Average Molecular Weight of Resin)

The molecular weights (the weight average molecular weight and the number average molecular weight) of each resin (the non-hybrid crystalline polyester resin, the hybrid crystalline polyester resin, the amorphous resin, or the like) by GPC are measured as follows. Specifically, using a device "HLC-8120GPC" (manufactured by Tosoh Corporation) and a column "TSK guard column+TSK gel Super HZ-M triple" (manufactured by Tosoh Corporation), tetrahydrofuran (THF) as a carrier solvent is flown at a flow rate of 0.2 mL/min while the column temperature is retained at 40° C. The measurement sample (resin) is dissolved in tetrahydrofuran so as to give a concentration of 1 mg/ml. The solution is prepared by conducting a treatment by using an ultrasonic dispersing machine at room temperature for 5 minutes. Secondly, the resulted solution is treated by a membrane filter having a pore size 0.2 μm to give a sample solution, and 10 μL of this sample solution is injected into a device together with the above-mentioned carrier solvent and detected by using an refractive index detector (an RI detector). Based on a calibration curve prepared by using monodispersed polystyrene standard particles, the molecular weight distribution of the measurement sample is calculated. Ten polystyrenes are used for the measurement of the above-mentioned calibration curve.

(Process for Producing Non-hybrid Crystalline Polyester Resin)

The process for producing the non-hybrid crystalline polyester resin is not specifically limited, and the resin can be produced by utilizing a known esterification catalyst by polycondensing (esterifying) the above-mentioned polycarboxylic acid and polyalcohol.

Examples of the catalyst that can be used in the production include alkali metal compounds of sodium, lithium, and the like; compounds containing a Group II element such as magnesium or calcium; compounds of metals such as aluminum, zinc, manganese, antimony, titanium, tin, zirconium, and germanium; phosphite compounds; phosphate compounds; and amine compounds; and the like. Considering availability and the like, it is preferable to use dibutyltin oxide, tin ocrylate, tin dioctylate and salts thereof, tetra n-butyl titanate (tetrabutyl orthotitanate) ($Ti(O\text{-}n\text{-}Bu)_4$), tetraisopropyl titanate (titanium tetraisopropoxide), tetramethyl titanate, and the like. These may be used by solely one kind or in combination of two or more kinds.

The temperature for the polycondensation (esterification) is not specifically limited, and is preferably 150 to 250° C. Furthermore, the time for the polycondensation (esterification) is not specifically limited, and is preferably 0.5 to 15 hours. During the polycondensation, the pressure in the reaction system may be reduced as necessary.

Furthermore, in the present invention, at least the crystalline polyester resin contained in the toner containing a colorant having a high resistance other than the toner containing a colorant having the lowest resistance contains a hybrid crystalline polyester resin in which a crystalline polyester polymerized segment and an amorphous polymerized segment are bonded. The hybrid crystalline polyester resin will be explained below.

[Hybrid Crystalline Polyester Resin]

The hybrid crystalline polyester resin (also abbreviated as hybrid resin) is a resin in which a crystalline polyester polymerized segment and an amorphous polymerized segment are chemically bonded.

The crystalline polyester polymerized segment refers to a molecular chain that constitutes the crystalline polyester resin. Furthermore, the amorphous polymerized segment refers to a molecular chain that constitutes the amorphous resin.

(Weight Average Molecular Weight of Hybrid Resin)

The weight average molecular weight (Mw) of the hybrid resin is preferably in the range of 5,000 to 100,000, more preferably in the range of 7,000 to 50,000, and specifically preferably in the range of 8,000 to 40,000, from the viewpoint of ensuring a balance between a sufficient low temperature fixing property and an excellent long term storage stability. By setting the weight average molecular weight (Mw) of the hybrid resin to 100,000 or less, a sufficient low temperature fixing property can be obtained. On the other hand, by setting the weight average molecular weight (Mw) of the hybrid resin to 5,000 or more, in a case where the hybrid resin and an amorphous resin are used in combination as binder resins during the storage of the toner, excessive progression of the compatibility of these resins is suppressed, whereby image defect due to the melt-bonding of the toners can be effectively suppressed.

(Crystalline Polyester Polymerization Segment in Hybrid Resin)

The crystalline polyester polymerized segment refers to a part derived from a known polyester resin obtained by a polycondensation reaction of a bi- or more valent carboxylic acid (a polycarboxylic acid) and a bi- or more valent alcohol (a polyalcohol) which is a polymerized segment having not a stepwise endothermic change but a clear endothermic peak in the differential scanning calorimetry of the toner.

The crystalline polyester polymerized segment is not specifically limited as long as it is as defined above. For example, for a resin having a structure formed by copolymerizing a main chain by a crystalline polyester polymerized segment with other component, and a resin having a structure formed by copolymerizing a crystalline polyester polymerized segment with a main chain formed of other component, if the resin (or a toner containing the resin) shows a clear endothermic peak as mentioned above, then the resin falls within the hybrid resin having a crystalline polyester polymerized segment as referred to in the present invention.

Furthermore, the valency numbers of the polycarboxylic acid component and the polyalcohol component are each preferably 2 to 3, and each specifically preferably 2. Therefore, a case where the respective valency numbers are 2 (i.e., the dicarboxylic acid component and the diol component) is explained as a specifically preferable embodiment.

As the dicarboxylic acid component, it is preferable to use an aliphatic dicarboxylic acid, and an aromatic dicarboxylic acid may also be used in combination. As the aliphatic dicarboxylic acid, a straight chain-type aliphatic dicarboxylic acid is preferably used. It is advantageous that the crystallinity is improved by using a straight chain-type aliphatic dicarboxylic acid. The dicarboxylic acid component is not limited to one kind, and two or more kinds may be mixed and used.

Examples of the aliphatic dicarboxylic acid include oxalic acid, malonic acid, succinic acid, glutalic acid, adipic acid, pimelic acid, suberic acid, azelaic acid, sebacic acid, 1,9-nonanedicarboxylic acid, 1,10-decanedicarboxylic acid (dodecane diacid), 1,11-undecanedicarboxylic acid, 1,12-dodecanedicathoxylic acid (tetradecane diacid), 1,13-tridecanedicarboxylic acid, 1,14-tetradecanedicarboxylic acid, 1,16-hexadecanedicarboxylic acid, 1,18-octadecanedicarboxylic acid, and the like, and lower alkyl esters and acid anhydrides of these can also be used.

Among the above-mentioned aliphatic dicarboxylic acids, aliphatic dicarboxylic acids having 6 to 12 carbon atoms are preferable since the above-mentioned effect is easily obtained.

Examples of the aromatic dicathoxylic acid that can be used together with the aliphatic dicarboxylic acid include telephthalic acid, isophthalic acid, orthophthalic acid, t-butylisophthalic acid, 2,6-naphthalenedicarboxylic acid, 4,4'-biphenyldicarboxylic acid, and the like. Among these, telephthalic acid, isophthalic acid, and t-butylisophthalic acid are preferably used in view of availability and easiness of emulsification.

As the dicarboxylic acid component for forming the crystalline polyester polymerized segment, the content of the aliphatic dicarboxylic acid is preferably 50 mol % or more, more preferably 70 mol % or more, further preferably 80 mol % or more, and specifically preferably 100 mol %. By setting the content of the aliphatic dicathoxylic acid in the dicarboxylic acid component to be 50 mol % or more, the crystallinity of the crystalline polyester polymerized segment can be sufficiently ensured.

Furthermore, as the diol component, the aliphatic diol is preferably used, and where necessary, diols other than the aliphatic diol may also be incorporated. As the aliphatic diol, a straight chain-type aliphatic diol is preferably used. By using the straight chain-type aliphatic diol, an advantage that the crystallinity is improved is obtained. The diol component may be used by solely one kind, or two or more kinds of diol components may be used.

Examples of the aliphatic diol include ethylene glycol, 1,3-propanediol, 1,4-butanediol, 1,5-pentandiol, 1,6-hexanediol, 1,7-heptanediol, 1,8-octandiol, 1,9-nonanediol, 1,10-dodecanediol, 1,11-undecanediol, 1,12-dodecanediol, 1,13-tridecanediol, 1,14-tetradecanediol, 1,18-octadecanediol, 1,20-eicosandiol, and the like.

As the diol component, since the above-mentioned effect is easily obtained, aliphatic diols having 2 to 12 carbon atoms are preferable, and aliphatic diols having 6 to 12 carbon atoms are more preferable among the aliphatic diols.

Examples of the diols other than the aliphatic diol used as necessary include diols having a double bond, diols having a sulfonic acid group, and the like, and specific examples of the diol having a double bond include 2-butene-1,4-diol, 3-butene-1,6-diol, 4-butene-1,8-diol, and the like.

As the diol component for forming the crystalline polyester polymerized segment, the content of the aliphatic diol is preferably set to 50 mol % or more, more preferably 70 mol % or more, further preferably 80 mol % or more, and specifically preferably 100 mol %. By setting the content of the aliphatic diol in the diol component to 50 mol % or more, the crystallinity of the crystalline polyester polymerized segment can be ensured. By this way, the toner produced by using the dispersion liquid of the present invention has an excellent low temperature fixing property and excellent in the glossiness of the finally formed image.

The use ratio of the above-mentioned diol component to the dicarboxylic acid component is such that the equivalent amount ratio [OH]/[COOH] of the hydroxy group [OH] in the diol component to the carboxy group [COOH] in the dicarboxylic acid component is set to be in the range of preferably 1.5/1 to 1/1.5, and further preferably 1.2/1 to 1/1.2.

The process for forming the crystalline polyester polymerized segment is not specifically limited, and the segment can be formed by the polycondensation (esterification) of the above-mentioned polycarboxylic acid and polyalcohol by utilizing a known esterification catalyst.

Examples of the catalyst that can be used in the production of the crystalline polyester polymerized segment include compounds of alkali metals such as sodium and lithium; compounds of metals of the Group II in the Element Periodic Table such as magnesium and calcium; compounds of metals such as aluminum, zinc, manganese, antimony, titanium, tin, zirconium, and germanium; phosphite compounds; phosphate compounds; and amine compounds; and the like.

Specific examples of the tin compound can include dibutyltin oxide, tin octylate, tin dioctylate and salts thereof, and the like. Examples of the titanium compound include titanium alkoxides such as tetra-n-butyl titanate, tetraisopropyl titanate, tetramethyl titanate, and tetrastearyl titanate; titanium acylates such as polyhydroxytitanium stearate; titanium chelates such as titanium tetraacetylacetonate, titanium lactate, and titaniumtriethanol aminate; and the like. Examples of the germanium compound can include germanium dioxide and the like. Furthermore, examples of the aluminum compound can include oxides such as aluminum polyhydroxide, aluminum alkoxides, and the like, and can include tributyl aluminate and the like. These can be used by solely one kind, or in combination of two or more kinds.

The polymerization temperature is not specifically limited, and is preferably in the range of 150 to 250° C. Furthermore, the polymerization time is not specifically limited, and is preferably in the range of 0.5 to 10 hours. Where necessary, the pressure in the reaction system may be reduced during the polymerization.

The constitutional components and content rate of each segment in the hybrid resin can be specified by, for example, an NMR measurement or a methylation reaction Py-GC/MS measurement.

Here, the hybrid resin contains, besides the above-mentioned crystalline polyester polymerized segment, an amorphous polymerized segment, which is mentioned below in detail. The hybrid resin may have any form such as a block copolymer, a graft copolymer, or the like as long as it contains the above-mentioned crystalline polyester polymerized segment and amorphous polymerized segment, and is preferably a graft copolymer. By forming a graft copolymer, the orientation of the crystalline polyester polymerized segment is easily controlled, and sufficient crystallinity can be imparted to the hybrid resin.

Furthermore, from the above-mentioned viewpoint, it is preferable that the crystalline polyester polymerized segment is grafted with the amorphous polymerized segment as a main chain. That is, it is preferable that the hybrid crystalline polyester resin is a graft copolymer having the amorphous polymerized segment as a main chain and having the crystalline polyester polymerized segment as the side chain.

By having the above-mentioned form, the orientation of the crystalline polyester polymerized segment can further be enhanced, and thus the crystallinity of the hybrid resin can be improved.

Substituents such as a sulfonic acid group, a carboxy group, and a urethane group can be introduced into the hybrid resin. The above-mentioned substituent may be introduced into the crystalline polyester polymerized segment, or into the amorphous polymerized segment explained below.

(Amorphous Polymerized Segment in Hybrid Resin)

The amorphous polymerized segment is a part derived from an amorphous resin other than the above-mentioned crystalline polyester resin in the hybrid resin. In a case where the hybrid resin and the amorphous resin are used in combination as the binder resins, the amorphous polymerized segment has a function to control the affinity of these resins, and in a case where the hybrid resin and the amorphous resin are used in combination as the binder resins of the toner, by allowing the amorphous polymerized segment to present, the affinity of these resins is improved and the hybrid resin is easily taken into the amorphous resin, and thus charging homogenicity and the like can be improved.

That the amorphous polymerized segment is contained in the hybrid resin (further in the toner) can be confirmed, for example, by specifying the chemical structure by using an NMR measurement or a methylation reaction Py-GC/MS measurement.

Furthermore, the amorphous polymerized segment is a polymerized segment that does not have any melting point but has a relatively high glass transition temperature (Tg) when a resin having the same chemical structure and molecular weight as that of the segment is subjected to differential scanning calorimetry (DSC). At this time, the resin having the same chemical structure and molecular weight as that of the segment has a glass transition temperature (Tg1) during the first temperature raising process in the DSC measurement preferably in the range of 30 to 80° C., and specifically preferably in the range of 40 to 65° C.

The amorphous polymerized segment is not specifically limited as long as it is as defined above. For example, for a resin obtained by copolymerizing other component with a main chain by an amorphous polymerized segment, and a resin having a structure in which the amorphous polymerized segment is copolymerized to a main chain formed of other component, if this resin (or a toner containing the resin) has the amorphous polymerized segment as mentioned above, then the resin falls within a hybrid resin having an amorphous polymerized segment as referred to in the present invention.

It is preferable that the amorphous polymerized segment is constituted by a resin of the same kind as the amorphous resin contained in the binder resin used for the production of the toner. By having such a form, the affinity between the hybrid resin and the amorphous resin is further improved, the hybrid resin is taken into the amorphous resin more easily, and the charging evenness and the like are further improved.

Here, "a resin of the same kind" means that a characteristic chemical bond is commonly contained in the repeating units. Here, "the characteristic chemical bond" follows "the Classification of Polymers" described in the NIMS material database by the National Institute for Materials Science (NIMS) (http://polymernims.gojp/PoLyInfo/guide/jp/term_polymer.html). That is, the chemical bonds that constitute polymers classified by total 22 kinds: polyacrylic, polyamide, polyacid anhydride, polycarbonate, polydiene, polyester, polyhaloolefin, polyimide, polyimine, polyketone, polyolefin, polyether, polyphenylene, polyphosphazene, polysiloxane, polystyrene, polysulfide, polysulfone, polyurethane, polyurea and polyvinyl polymers, and other polymers are referred to as "the characteristic chemical bonds".

Furthermore, "resins of the same kind" in a case where the resins are copolymers refers to resins having a common characteristic chemical bond in a case where a monomer species having the above-mentioned chemical bond is used as a constitutional unit in the chemical structures of plural monomer species that constitute the copolymers. Therefore, even in a case where the properties shown by the resins themselves are different from each other, and a case where the mol component ratios of the monomer species constituting the copolymers are different from each other, the resins are deemed as resins of the same kind as long as they have a common characteristic chemical bond.

For example, since a resin (or a polymerized segment) formed by styrene, butyl acrylate, and acrylic acid and a resin (or a polymerized segment) formed by styrene, butyl acrylate, and methacrylic acid have at least a chemical bond that constitutes a polyacrylic, these are resins of the same kind. In further exemplification, a resin (or a polymerized segment) formed by styrene, butyl acrylate, and acrylic acid and a resin (or a polymerized segment) formed by styrene, butyl acrylate, acrylic acid, telephthalic acid, and fumaric acid have at least a chemical bond that constitutes a polyacrylic as a common chemical bond. Therefore, these are resins of the same kind.

The resin component that constitutes the amorphous polymerized segment is not specifically limited, and examples include a vinyl polymerized segment, a urethane polymerized segment, a urea polymerized segment, and the like. Among these, a vinyl polymerized segment is preferable since thermoplasticity is easily controlled.

The vinyl polymerized segment is not specifically limited as long as it is obtained by polymerizing a vinyl compound, and examples include an acrylic acid ester polymerized segment, a styrene-acrylic acid ester polymerized segment, an ethylene-vinyl acetate polymerized segment, and the like. These may be used by solely one kind, or in combination of two or more kinds.

Among the above-mentioned vinyl polymerized segments, a styrene-acrylic acid ester polymerized segment (a styrene-acrylic polymerized segment) is preferable in view of formation of a homogeneous and fine domain structure of a plasticizer. Therefore, the styrene-acrylic polymerized segment as the amorphous polymerized segment will be explained below.

The styrene-acrylic polymerized segment is formed by addition polymerization of at least a styrene monomer and a (meth)acrylic acid ester monomer. The styrene monomer as referred to herein includes a styrene represented by the structural formula of $CH_2{=}CH{-}C_6H_5$, as well as styrenes containing known side chains and/or functional groups in a styrene structure. Furthermore, the (meth)acrylic acid ester monomer as referred to herein includes an acrylic acid ester compound or methacrylic acid ester compound represented by $CH_2{=}CHCOOR$ (R is an alkyl group), as well as ester compounds having known side chains and/or functional groups in an acrylic acid ester derivative or a methacrylic acid ester derivative.

Specific examples of the styrene monomer and the (meth) acrylic acid ester monomer from which the styrene-acrylic polymerized segment can be formed are shown below, but the monomers that can be used for the formation of the styrene-acrylic polymerized segment used in the present invention are not limited to those shown below.

Firstly, specific examples of the styrene monomer include styrene, o-methylstyrene, m-methylstyrene, p-methylstyrene, α-methylstyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene, p-n-dodecylstyrene, and the like. These styrene monomers can be used solely or in combination of two or more kinds.

Furthermore, specific examples of the (meth)acrylic acid ester monomer include acrylic acid ester monomers such as methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate, and phenyl acrylate; methacrylic acid esters such as methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate, and dimethylaminoethyl methacrylate; and the like.

In the present specification, "a (meth)acrylic acid ester monomer" is a collective term of "an acrylic acid ester monomer" and "a methacrylic acid ester monomer", and for example, "methyl (meth)acrylate" is a collective term of "methyl acrylate" and "methyl methacrylate".

These acrylic acid ester monomers or methacrylic acid ester monomers can be used solely or in combination of two or more kinds. That is, it is possible to form a copolymer by using a styrene monomer and two or more kinds of acrylic acid ester monomers, to form a copolymer by using a styrene monomer and two or more kinds of methacrylic acid ester monomers, or to form a copolymer by using a styrene monomer, an acrylic acid ester monomer, and a methacrylic acid ester monomer in combination.

The content rate of the constitutional unit derived from the styrene monomer in the amorphous polymerized segment is preferably in the range of 40 to 90% by mass with respect to the whole amount of the amorphous polymerized segment. Furthermore, the content rate of the constitutional unit derived from the (meth)acrylic acid ester monomer in the amorphous polymerized segment is preferably in the range of 10 to 60% by mass with respect to the whole amount of the amorphous polymerized segment. By setting the content rate to be within such a range, the flexibility of the hybrid resin is easily controlled.

Furthermore, it is preferable that the amorphous polymerized segment is formed by addition polymerization of a compound for chemically bonding to the above-mentioned crystalline polyester polymerized segment in addition to the above-mentioned styrene monomer and (meth)acrylic acid ester monomer. Specifically, it is preferable to use a compound that is ester-bonded to a hydroxy group [—OH] derived from a polyalcohol or a carboxy group [—COOH] derived from a polycarboxylic acid, which is contained in the above-mentioned crystalline polyester polymerized segment. Therefore, it is preferable that the amorphous polymerized segment can be addition-polymerized with the above-mentioned styrene monomer and (meth)acrylic acid ester monomer, and is formed by further polymerizing with the compound having a carboxy group [—COOH] or a hydroxy group [—OH].

Examples of such a compound include compounds having a carboxy group such as acrylic acid, methacrylic acid, maleic acid, itaconic acid, cinnamic acid, fumaric acid, maleic acid monoalkyl esters, and itaconic acid monoalkyl esters; and compounds having a hydroxy group such as 2-hydroxyethyl (meth)acrylate, 2-hydroxypropyl (meth) acrylate, 3-hydroxypropyl (meth)acrylate, 2-hydroxybutyl (meth)acrylate, 3-hydroxybutyl (meth)acrylate, 4-hydroxybutyl (meth)acrylate, and polyethylene glycol mono (meth) acrylate.

The content rate of the constitutional unit derived from the above-mentioned compound in the amorphous polymerized segment is preferably in the range of 0.5 to 20% by mass with respect to the whole amount of the amorphous polymerized segment.

The process for forming the styrene-acrylic polymerized segment is not specifically limited, and a process for polymerizing monomers by using a known oil-soluble or water-soluble polymerization initiator. Specific examples of the oil-soluble polymerization initiator include azo-based or diazo-based polymerization initiators and peroxide-based polymerization initiators shown below.

Examples of the azo-based or diazo-based polymerization initiator include 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, azobisisobutyronitrile, and the like.

Examples of the peroxide-based polymerization initiator include benzoyl peroxide, methyl ethyl ketone peroxide, diisopropyl peroxycarbonate, cumene hydroperoxide, t-butylhydroperoxide, di-t-butyl peroxide, dicumyl peroxide, 2,4-dichlorobenzoyl peroxide, lauroyl peroxide, 2,2-bis-(4, 4-t-butylperoxycyclohexyl)propane, tris-(t-butylperoxy)triazine, and the like.

Furthermore, in a case where resin particles are formed by an emulsification polymerization process, a water-soluble radical polymerization initiator can be used. Examples of the water-soluble polymerization initiator include persulfate salts such as potassium persulfate and ammonium persulfate, azobisaminodipropane acetate salt, azobiscyanovaleric acid and salts thereof, hydrogen peroxide, and the like.

(Process for Producing Hybrid Resin)

The process for producing the hybrid resin is not specifically limited as long as it is a process capable of forming a polymer having a structure in which the above-mentioned crystalline polyester polymerized segment and the amorphous polymerized segment are chemically bonded. Examples of a specific process for producing the hybrid resin include the process shown below.

(1) A process in which an amorphous polymerized segment is polymerized in advance, and a polymerization reaction for forming a crystalline polyester polymerized segment is conducted in the presence of the amorphous polymerized segment to produce a hybrid resin.

In this process, firstly, monomers that constitute the above-mentioned amorphous polymerized segment (preferably vinyl monomers such as a styrene monomer and a (meth)acrylic acid ester monomer) are addition-reacted to form an amorphous polymerized segment. Secondly, a polycarboxylic acid and a polyalcohol are subjected to a polymerization reaction in the presence of the amorphous polymerized segment to form a crystalline polyester polymerized segment. During this method, the polycarboxylic acid and the polyalcohol are condensed, and the polycarboxylic acid or the polyalcohol is addition-reacted with the amorphous polymerized segment, whereby the hybrid resin is formed.

In this process, it is preferable to incorporate a site that can react with the crystalline polyester polymerized segment or the amorphous polymerized segment in advance in the segment.

Specifically, in the formation of the amorphous polymerized segment, besides the monomers that constitute the amorphous polymerized segment, a compound having a site that can react with the carboxy group [—COOH] or hydroxy group [—OH] remaining in the crystalline polyester polymerized segment and a site that can react with the amorphous polymerized segment is also used. That is, by the reaction of this compound with the carboxy group [—COOH] or hydroxy group [—OH] in the crystalline polyester polymerized segment, the crystalline polyester polymerized segment can chemically bind to the amorphous polymerized segment.

Alternatively, during the formation of the crystalline polyester polymerized segment, a compound having a site that can react with the polyalcohol or polycarboxylic acid and can react with the amorphous polymerized segment may also be used.

By using this process, a hybrid resin having a structure in which the crystalline polyester polymerized segment is chemically bonded to the amorphous polymerized segment (graft structure) can be formed.

(2) A process in which a crystalline polyester polymerized segment and an amorphous polymerized segment are formed respectively, and these segments are bonded to form a hybrid resin.

In this process, a polycarboxylic acid and a polyalcohol are subjected to a condensation reaction to form a crystalline polyester polymerized segment. Furthermore, separately from the reaction system for forming the crystalline polyester polymerized segment, a monomer for constituting the above-mentioned amorphous polymerized segment is addition-polymerized to form an amorphous polymerized segment. At this time, it is preferable to incorporate in advance a site in which the crystalline polyester polymerized segment and the amorphous polymerized segment can be reacted with each other. Since the process for incorporating such reactable site is as mentioned above, the detailed explanation thereof is omitted.

Secondly, by reacting the crystalline polyester polymerized segment formed above and the amorphous polymerized segment, a hybrid resin having a structure in which the crystalline polyester polymerized segment and the amorphous polymerized segment are chemically bonded can be formed.

Furthermore, in a case where the above-mentioned reactable site is not incorporated in the crystalline polyester polymerized segment and the amorphous polymerized segment, it is also possible to form a system in which the crystalline polyester polymerized segment and the amorphous polymerized segment are present together in advance, and adopt a process to inject a compound having a site that can bond to the crystalline polyester polymerized segment and the amorphous polymerized segment in the system. Furthermore, a hybrid resin having a structure in which the crystalline polyester polymerized segment and the amorphous polymerized segment are chemically bonded can be formed via the compound.

(3) A process in which a crystalline polyester polymerized segment is formed in advance, and a polymerization reaction for forming an amorphous polymerized segment is conducted in the presence of the crystalline polyester polymerized segment to produce a hybrid resin.

In this process, firstly, a polycarboxylic acid and a polyalcohol are polymerized by a condensation reaction to form a crystalline polyester polymerized segment. Secondly, a monomer that constitutes an amorphous polymerized segment is subjected to a polymerization reaction in the presence of the crystalline polyester polymerized segment to form an amorphous polymerized segment. At this time, it is preferable to incorporated in advance a site in which the crystalline polyester polymerized segment and the amorphous polymerized segment are reactable with each other in the crystalline polyester polymerized segment or the amorphous polymerized segment in a similar manner to that in the above-mentioned (1). Since the process for incorporating such reactable site is as mentioned above, the detailed explanation thereof is omitted.

By using the above-mentioned process, a hybrid resin having a structure in which the amorphous polymerized segment is chemically bonded to the crystalline polyester polymerized segment (graft structure) can be formed.

Among the formation processes of the above-mentioned (1) to (3), the process of (1) is preferable since a hybrid resin having a structure in which the crystalline polyester resin chain is grafted to the amorphous resin chain is easily formed, and the production steps can be simplified. In the process of (1), since the crystalline polyester polymerized segment is bonded after the amorphous polymerized segment has been formed in advance, the orientation of the crystalline polyester polymerized segment easily becomes homogeneous. Accordingly, the process of (1) is preferable since a hybrid resin that is suitable for the toner defined in the present invention can be surely formed.

<<Amorphous Resin>>

The toner particles contain an amorphous resin as a binder resin. It is preferable that the amorphous resin is a major component of the binder resin to be incorporated in each toner. By incorporating the amorphous resin as a major component in the binder resin, the amorphous resin is easily present on the surfaces of the toner particles. As a result, the charging property of the toner particles can be improved due to the high electrical resistance of the amorphous resin. The "major component" herein means that the resin is contained at the highest content rate in the binder resin. The amorphous resin is preferably 50% by mass or more, more preferably 70 to 99% by mass, further more preferably 80 to 97% by mass, and specifically preferably 83 to 94% by mass with respect to the entirety of the binder resin.

The amorphous resin as used herein is a resin having no melting point but having a relatively high glass transition temperature (Tg) in conducting a differential scanning calorimetry (DSC). At this time, the glass transition temperature (Tg) is preferably 30 to 80° C., and specifically preferably 40 to 65° C. The glass transition temperature (Tg) can be measured by a differential scanning calorimeter (DSC), and specifically, the glass transition temperature (Tg) is measured by the process described in Examples. The above-mentioned glass transition temperature can be controlled by any person skilled in the art by the composition of the resin.

As the amorphous resin, conventionally-known amorphous resins in this technical field can be used, and among these, amorphous polyester resins or vinyl resins are preferable, and these resins may be mixed and used.

(Amorphous Polyester Resin)

The amorphous polyester resin is a polyester resin, and is a resin having no melting point but having a relatively high glass transition temperature (Tg) in conducting a differential scanning calorimetry (DSC). Since the scope of preferable glass transition temperatures is as mentioned above, the explanation thereof is omitted here. Furthermore, since the monomer that constitutes the amorphous polyester resin is different from the monomer that constitutes the crystalline polyester resin, it can be distinguished from the crystalline polyester resin by, for example, an analysis by NMR or the like. Due to such differences in the kind and structure (crystalline or amorphous) of the monomer, the amorphous polyester resin can be said to be a resin having a higher electrical resistance than that of the crystalline polyester resin.

The amorphous polyester resin can be obtained by a polycondensation reaction between a bi- or more valent carboxylic acid (polycarboxylic acid) and a bi- or more valent alcohol (polyalcohol). The amorphous polyester resin is not specifically limited, and a conventionally-known amorphous polyester resin in this technical field can be used.

Examples of the polycarboxylic acid and the polyalcohol used for the preparation of the amorphous polyester resin include, but are not specifically limited to, the following ones.

(Polycarboxylic Acid)

As the polycarboxylic acid, unsaturated aliphatic polycarboxylic acids, aromatic polycarboxylic acids, and derivatives thereof are preferably used. Saturated aliphatic polycarboxylic acids may also be used in combination as long as an amorphous resin can be used.

Examples of the above-mentioned unsaturated aliphatic polycarboxylic acid include unsaturated aliphatic dicarboxylic acids such as methylenesuccinic acid, fumaric acid, maleic acid, 3-hexenedioic acid, 3-octenedioic acid, and succinic acids substituted with an alkenyl group having 2 or more to 20 or less carbon atoms: unsaturated aliphatic tricarboxylic acids such as 3-butene-1,2,3-tricarboxylic acid, 4-pentene-1,2,4-tricarboxylic acid, and aconitic acid; unsaturated aliphatic tetracarboxylic acids such as 4-pentene-1,2,3,4-tetracarboxylic acid; and the like, and lower alkyl esters and acid anhydrides thereof can also be used.

Examples of the above-mentioned aromatic polycarboxylic acid include aromatic dicarboxylic acids such as phthalic acid, telephthalic acid, isophthalic acid, t-butylisophthalic acid, tetrachlorophthalic acid, chlorophthalic acid, nitrophthalic acid, p-phenylenediacetic acid, 2,6-naphthalenedicarboxylic acid, 4,4'-biphenyldicarboxylic acid, and anthracenedicarboxylic acid; aromatic tricarboxylic acids such as 1,2,4-benzenetricarboxylic acid (trimellitic acid), 1,2,5-benzenetricarboxylic acid (trimesic acid), 1,2,4-naphthalenetricarboxylic acid, and hemimellitic acid; aromatic tetracarboxylic acids such as pyromellitic acid and 1,2,3,4-butanetetracarboxylic acid; aromatic hexacarboxylic acids such as mellitic acid; and the like, and lower alkyl esters and acid anhydrides thereof can also be used. The above-mentioned polycarboxylic acids may be used solely or by mixing two or more kinds.

(Polyalcohol)

As the polyalcohol, unsaturated aliphatic polyalcohols, aromatic polyalcohols, and derivatives thereof are preferably used in view of charging property. Saturated aliphatic polyalcohols may also be used in combination as long as an amorphous resin can be obtained.

Examples of the above-mentioned unsaturated aliphatic polyalcohol includes unsaturated aliphatic diols such as 2-butene-1,4-diol, 3-butene-1,4-diol, 2-butyne-1,4-diol, 3-butyne-1,4-diol, 9-octadecene-7,12-diol, and the like, and derivatives thereof can also be used.

Examples of the above-mentioned aromatic polyalcohols include bisphenols such as bisphenol A and bisphenol F, and alkylene oxide additives of bisphenols such as ethylene oxide additives and propylene oxide additive of these bisphenols, 1,3,5-benzenetriol, 1,2,4-benzenetriol, 1,3,5-trihydroxymethylbenzene, and the like, and derivatives thereof can also be used. Among these, from the viewpoint that the thermal property is optimized specifically easily, bisphenol A compounds such as ethylene oxide additives and propylene oxide additives of bisphenol A, and the like are preferably used.

Furthermore, the number of the carbon atoms in the tri- or more valent polyalcohol is not specifically limited, and the carbon atoms are specifically preferably 3 to 20 since the thermal property is easily optimized.

The above-mentioned polyalcohols may be used solely or by mixing two or more kinds.

(Process for Producing Amorphous Polyester Resin)

The process for producing the amorphous polyester resin is not specifically limited, and the resin can be produced by the polycondensation (esterification) of the above-mentioned polycarboxylic acid and polyalcohol by utilizing a known esterification catalyst.

The catalyst that can be used in the production, the temperature for the polycondensation (esterification), and the time for the polycondensation (esterification) are not specifically limited, and are as described in the above-mentioned <<Crystalline Polyester Resin>>, and thus the detailed explanation thereof is omitted.

(Weight Average Molecular Weight (Mw) of Amorphous Polyester Resin)

The weight average molecular weight (Mw) of the amorphous polyester resin is not specifically limited, and is preferably in the range of 5,000 to 100,000, and more preferably in the range of 5,000 to 50,000. If the above-mentioned weight average molecular weight (Mw) is 5,000 or more, the heat-resistant retention property of the toner can be improved, whereas when the weight average molecular weight (Mw) is 100,000 or less, the low temperature fixing property can further be improved. The above-mentioned weight average molecular weight (Mw) can be measured by gel permeation chromatography (GPC), and specifically can be measured by the process described in Examples.

(Vinyl Resin)

The vinyl resin is a resin obtained by polymerization using at least a vinyl monomer. Specific examples of the vinyl resin include acrylic resins, styrene-acrylic copolymer resins (styrene-acrylic resins), and the like.

Among these, as the vinyl resin, a styrene-acrylic copolymer resin formed by using a styrene monomer and a (meth)acrylic acid ester monomer is preferable. The vinyl resins may be used solely or in combination of two or more kinds.

As the vinyl monomer(s) for forming the vinyl resin, one kind or two or more kinds selected from the following ones can be used.

(1) Styrene Monomers

Styrene, o-methylstyrene, m-methylstyrene, p-methylstyrene, α-methylstyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene, p-n-dodecylstyrene, and derivatives thereof, and the like.

(2) (Meth)Acrylic Acid Ester Monomers

Methyl (meth)acrylate, ethyl (meth)acrylate, n-butyl (meth)acrylate, isopropyl (meth)acrylate, isobutyl (meth) acrylate, t-butyl (meth)acrylate, n-octyl (meth)acrylate, 2-ethylhexyl (meth)acrylate, stearyl (meth)acrylate, lauryl (meth)acrylate, phenyl (meth)acrylate, diethylaminoethyl (meth)acrylate, dimethylaminoethyl (meth)acrylate, and derivatives thereof, and the like.

(3) Vinyl Esters

Vinyl propionate, vinyl acetate, vinyl benzoate, and the like.

(4) Vinyl Ethers

Vinyl methyl ether, vinyl ethyl ether, and the like.

(5) Vinyl Ketones Vinyl methyl ketone, vinyl ethyl ketone, vinyl hexyl ketone, and the like.

(6) N-Vinyl Compounds

N-vinylcarbazole, N-vinylindole, N-vinylpyrrolidone, and the like.

(7) Others

Vinyl compounds such as vinylnaphthalene and vinylpyridine, acrylic acid, or methacrylic acid derivatives such as acrylonitrile, metacrylonitrile, acrylamide, and the like.

Furthermore, as the vinyl monomer, for example, monomers having ionizable groups such as a carboxyl group, a sulfonic acid group, and a phosphate group are preferably used. Specific examples include the following ones.

Examples of the monomer having a carboxyl group include acrylic acid, methacrylic acid, maleic acid, itaconic acid, cinnamic acid, fumaric acid, maleic acid monoalkyl esters, itaconic acid monoalkyl esters, and the like. Furthermore, examples of the monomer having a sulfonic acid group include styrenesulfonic acid, allylsulfosuccinic acid, 2-acrylamide-2-methylpropanesulfonic acid, and the like. Furthermore, examples of the monomer having a phosphate group include acid phosphoxy ethyl methacrylate and the like.

Furthermore, a vinyl resin having a crosslinking structure may be formed by using multifunctional vinyls as the vinyl monomer. Examples of the multifunctional vinyls include divinylbenzene, ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol dimethacrylate, neopentyl glycol diacrylate, and the like.

(Process for Producing Vinyl Resin)

The process for producing the vinyl resin is not specifically limited, and examples include a process for conducting polymerization by a known polymerization means such as bulk polymerization, solution polymerization, an emulsification polymerization process, a mini-emulsion process, or a dispersion polymerization process by using an optional polymerization initiator such as a peroxide, a persulfate salt, a persulfate, or an azo compound that is generally used in the polymerization of the above-mentioned monomers. Furthermore, a generally-used chain transfer agent can be used for the purpose of adjusting the molecular weight. The chain transfer agent is not specifically limited, and examples can include alkylmercaptanes, mercaptoaliphatic acid esters, and the like.

(Weight Average Molecular Weight (Mw) of Vinyl Resin)

Furthermore, the molecular weight measured by gel permeation chromatography (GPC) of the vinyl resin is preferably a weight average molecular weight (Mw) of 10,000 to 100,000.

In the present invention, the amorphous resin contained in each of the toners containing colorants of respective colors contains preferably a vinyl resin, and more preferably a styrene-acrylic resin. Since the vinyl resin (specifically the styrene-acrylic resin) has lesser functional groups having high polarity and lower hygroscopicity than those of the amorphous polyester resin, the transfer property is fine even under a strict environment such as a high temperature-high humidity environment. Therefore, the amorphous resin can have a fine transfer property under any environment. The content of the styrene-acrylic resin in the amorphous resin is not specifically limited. From the viewpoint of obtaining a fine transfer property under any environment as mentioned above, the content of the styrene-acrylic resin is preferably 50% by mass or more, more preferably 80% by mass or more, specifically preferably 90% by mass or more, and specifically preferably 100% by mass with respect to the whole amount of the amorphous resin.

<<Colorants>>

The toners containing colorants of respective colors each contain a colorant corresponding to each color, in addition to the binder resin (the crystalline polyester resin and the amorphous resin) and a mold release agent.

The content of each colorant is preferably 1 to 30 parts by mass, and more preferably 3 to 20 parts by mass with respect to 100 parts by mass of the toner particles. Furthermore, the color reproducibility of images can be ensured in such range.

The kinds of the colorants for the respective colors are explained below.

(Black-Based Colorants)

The colorant for black for use in a black toner is not specifically limited, and carbon blacks, magnetic bodies, dyes, other pigments, and the like can be arbitrarily used. As the carbon black, channel black, furnace black, acetylene black, thermal black, lamp black, or the like is used. As the magnetic bodies, ferromagnetic metals such as iron, nickel, or cobalt, alloys containing these metals, compounds of ferromagnetic metals such as ferrite or magnetite, and the like can be used. Furthermore, as the other pigments, titanium black, aniline black, and the like can be used.

Among these, the carbon blacks have relatively low resistance values. However, according to the present invention, in cases where such colorants are used, the charging property specifically under a high temperature-high humidity environment can be made fine, and thus the transfer property becomes fine.

(Yellow-Based Colorant)

The colorant for orange or yellow used in a yellow toner is not specifically limited. Examples include organic pigments such as C. I. Pigment Orange 31 and C. I. Pigment Orange 43, C. I. Pigment Yellow 12, C. I. Pigment Yellow 13, C. I. Pigment Yellow 14, C. I. Pigment Yellow 15, C. I. Pigment Yellow 17, C. I. Pigment Yellow 74, C. I. Pigment Yellow 93, C. I. Pigment Yellow 94, C. I. Pigment Yellow 138, C. I. Pigment Yellow 155, C. I. Pigment Yellow 180, C. I. Pigment Yellow 185, and the like. Furthermore, examples of the dye include C. I. Solvent Yellow 19, C. I. Solvent Yellow 44, C. I. Solvent Yellow 77, C. I. Solvent Yellow 79, C. I. Solvent Yellow 81, C. I. Solvent Yellow 82, C. I. Solvent Yellow 93, C. I. Solvent Yellow 98, C. I. Solvent Yellow 103, C. I. Solvent Yellow 104, C. I. Solvent Yellow 112, C. I. Solvent Yellow 162, and the like. These colorants may be used solely, or in combination of two or more kinds.

(Magenta-Based Colorants)

The colorant for magenta or red used for a magenta toner is not specifically limited. Examples include organic pigments such as C. I. Pigment Red 2, C. I. Pigment Red 3, C. I. Pigment Red 5, C. I. Pigment Red 6, C. I. Pigment Red 7, C. I. Pigment Red 15, C. I. Pigment Red 16, C. I. Pigment Red 48; 1, C. I. Pigment Red 53; 1, C. I. Pigment Red 57; 1, Pigment Red 81; 4, C. I. Pigment Red 122, C. I. Pigment Red 123, C. I. Pigment Red 139, C. I. Pigment Red 144, C. I. Pigment Red 149, C. I. Pigment Red 150, C. I. Pigment Red 166, C. I. Pigment Red 177, C. I. Pigment Red 178, Pigment Red 184, C. I. Pigment Red 222, C. I. Pigment Red 238, C. I. Pigment Red 269, and the like. Furthermore, examples of the dye include C. I. Solvent Red 1, Solvent Red 11, C. I. Solvent Red 49, C. I. Solvent Red 52, C. I. Solvent Red 58, C. I. Solvent Red 68, C. I. Solvent Red 111, C. I. Solvent Red 122, and the like. These colorants may be used solely, or in combination of two or more kinds.

(Cyan-Based Colorant)

The cyan colorant for green or cyan used for a cyan toner is not specifically limited. Examples include organic pigments such as C. I. Pigment Blue 15, C. I. Pigment Blue 15:2, C. I. Pigment Blue 15:3, C. I. Pigment Blue 15:4, C. I. Pigment Blue 16, C. I. Pigment Blue 60, C. I. Pigment Blue 62, C. I. Pigment Blue 66, C. I. Pigment Blue 76, C. I. Pigment Green 7, and the like. Furthermore, examples include dyes such as C. I. Solvent Blue 25, C. I. Solvent Blue 36, C. I. Solvent Blue 69, C. I. Solvent Blue 70, C. I. Solvent Blue 93, C. I. Solvent Blue 95, and the like. These colorants may be used solely, or in combination of two or more kinds.

Since the colorants (specifically organic pigments) used for the above-mentioned yellow toner, magenta toner, and cyan toner respectively have relatively high electrical resistances, the amount of charging on the surfaces of the toner particles increases under a low temperature-low humidity environment, and consequently, the transfer property is lowered. However, according to the present invention, even in cases where such colorants are used, the charging property specifically under a low temperature-low humidity environment can be appropriately decreased, and thus the dependency of an image concentration on an environment can be decreased.

(Size of Colorant Particles)

Furthermore, the size of the colorant (particles) is not specifically limited, and the median diameter on volume basis is preferably 10 to 1,000 nm, more preferably 50 to 500 nm, and specifically preferably 80 to 300 nm. Such range is preferable since high color reproducibility can be obtained and the range is appropriate for forming a toner with a small diameter which is necessary for a high image quality. The median diameter on volume basis of the colorant (particles) can be measured, for example by using a Microtrack (registered trademark, the same will apply below) particle size distribution meter "UPA-150" (manufactured by Nikkiso Co., Ltd.).

<<Mold Release Agent>>

Each of the toner particles in the toners containing colorants of respective colors used in the present invention contains a mold release agent (a wax).

Examples of the mold release agent include hydrocarbon-based waxes such as low molecular weight polyethylene waxes, low molecular weight polypropylene waxes, Fischer-Tropsch waxes, microcrystalline waxes and paraffin waxes, and ester waxes such as carnauba waxes, pentaerythritol behenic acid ester, behenyl behenate and behenyl citrate, and the like. These can be used by one kind or in combination of two or more kinds.

The content rate of the mold release agent is preferably 2 to 20% by mass, more preferably 3 to 18% by mass, and specifically preferably 5 to 15% by mass with respect to the whole amount of the binder resin.

Furthermore, the melting point of the mold release agent is preferably 50 to 95° C. in view of the low temperature fixing property and mold release property of a toner in an electrophotographic system.

<<Charge Controlling Agent>>

The toners containing colorants of respective colors used in the present invention may contain other internal additives as necessary. Examples of such internal additives include charge controlling agents. Examples of the charge controlling agents can include metal complexes of a salicylic acid derivative with zinc or aluminum (salicylic acid-metal complexes), calixarene compounds, organic boron compounds, fluorine-containing quaternary ammonium salt compounds, and the like.

The content rate of the charge controlling agent is preferably generally 0.1 to 10 parts by mass, and more preferably 0.5 to 5 parts by mass with respect to 100 parts by mass of the binder resin in the toner.

<<Form of Toner Particles>>

The toner particles may be toner particles each having a so-called single layer structure, or may be toner particles each having a core-shell structure (a form in which a resin that forms a shell layer is aggregated or melt-bonded on the surface of a core particle). It is preferable that the toner particles each having a core-shell structure have a form in which resin particles (core particles) having a relatively low glass transition temperature containing a colorant, a mold release agent and the like each has a resin region (a shell layer) having a relatively high glass transition temperature on the surface. The core-shell structure is not limited to a core-shell structure in which a core particle is completely coated with a shell layer, and also includes, for example, a core-shell structure in which a core particle is not completely coated with a shell layer and thus the core particle is exposed in spots.

The form of the above-mentioned toner particles (the cross-sectional surface structure of the core-shell structure, and the like) can be confirmed, for example, by using a known means such as a transmission electron microscope (TEM) or a scanning probe microscope (SPM).

<<Average Circularity of Toner Particles>>

From the viewpoint of improvement of the low temperature fixing property, the toner particles has an average circularity of preferably 0.920 to 1.000, and more preferably 0.940 to 0.995. The above-mentioned average circularity is a value measured by using "FPIA-2100" (manufactured by Sysmex). Specifically, toner particles are wet with an aqueous surfactant solution, dispersed by conducting ultrasonic dispersion for 1 minute, and measured by using "FPIA-2100" under a measurement condition of an HPF (high magnification imaging) mode at an appropriate concentration of an HPF detection number of 4,000. The circularity is calculated by the following formula.

Circularity=(a perimeter of a circle having an identical projection surface area with that of a particle image)/(a perimeter of a projection image of a particle)

Furthermore, the average circularity is a mathematical average value obtained by adding the circularities of the respective particles and dividing by a measured total number of the particles.

<<Particle Diameters of Toner Particles>>

The particle diameters of the toner particles are preferably such that a median diameter (D50) on volume basis is 3 to 10 μm. By setting the median diameter on volume basis to be within the above-mentioned range, reproducibility of thin lines and high image qualities of picture images can be achieved, and the consumed amount of the toner can be decreased more than in a case where a toner having a large particle size is used. Furthermore, the fluidity of the toner can also be ensured. Here, the median diameter (D50) on volume basis of the toner particles can be measured and calculated by, for example, using a device in which a computer system for data processing is connected to "Coulter Multisizer 3" (manufactured by Beckman Coulter).

The median diameter on volume basis of the toner particles can be controlled by the concentration of the flocculating agent in the aggregation/melt-bonding step during the production of the toner, which is mentioned below, the addition amount of the solvent, or the melt-bonding time, and the composition of the resin components, and the like.

<<External Additives>>

It is preferable that the toners containing colorants of respective colors in the present invention contain, on the surfaces of the toner particles, particles such as known inorganic particles and organic particles, a lubricant and the like as external additives, from the viewpoint of improvement of charging performance, fluidity or cleaning property. As the external additives, various external additives can be used in combination. Examples of the particles include inorganic oxide particles such as silica particles, alumina particles and titania particles, inorganic stearic acid compound particles such as aluminum stearate particles and zinc stearate particles, or inorganic titanate compound particles such as strontium titanate particles and zinc titanate particles, and the like. Furthermore, examples of the lubricant include metal salts of higher aliphatic acids such as salts of stearic acid with zinc, aluminum, copper, magnesium or calcium, salts of oleic acid with zinc, manganese, iron, copper or magnesium, salts of palmitic acid with zinc, copper, magnesium or calcium, salts of linoleic acid with zinc or calcium, and salts of ricinoleic acid with zinc or calcium. These external additives may be external additives that have undergone any surface treatment with a silane coupling agent, a titanium coupling agent, a higher aliphatic acid or a silicone oil, in view of heat-resistance retention property and environmental stability. The external additives can be used solely or by mixing two or more kinds.

Among the above-mentioned external additives, inorganic oxide particles such as silica particles (spherical silica), alumina particles, and titania particles are preferably used as external additives.

The addition amount of the external additive (in a case where two or more kinds of external additives are used, the total amount thereof) is preferably 0.05 to 5% by mass, and more preferably 0.1 to 3% by mass with setting the total mass of the toner containing the external additives as 100% by mass.

The particle diameter of the external additive is not specifically limited, and particles such as inorganic microparticles having a number average primary particle diameter of about 2 to 800 nm, and organic microparticles having a number average primary particle diameter of about 10 to 2,000 nm are preferable.

In the present specification, "number average primary particle diameter" refers to a value obtained by subjecting a scanning electron microscopic image of external additive particles to a binarization processing, calculating the horizontal Feret diameters of 10,000 particles, and obtaining the average thereof.

[Process for Producing Toner]

The process for producing a toner containing a colorant of each color (a toner for developing an electrostatic latent image) used in the present invention is explained below.

The process for producing a toner used in the present invention is not specifically limited, and examples include known processes such as a knead-pulverization process, a suspension polymerization process, an emulsification aggregation process, a solution suspension process, a polyester extension process, a dispersion polymerization process, and the like.

Among these, it is preferable to adopt an emulsification aggregation process in view of evenness of particle diameters, shape controlling property, and easiness of formation of a core-shell structure. The emulsification aggregation process is explained below.

<<Emulsification Aggregation Process>>

The emulsification aggregation process refers to a process in which a dispersion liquid of particles of a binder resin (hereinafter also referred to as "binder resin particles") dispersed by a surfactant or a dispersion stabilizer is mixed with a dispersion liquid of particles of a mold release agent (hereinafter also referred to as "mold release agent particles"), the mixture is aggregated to a desired particle diameter, and binder resin particles are further melt-bonded to control the shape to prepare toner particles. The particles of the binder resin may optionally contain a colorant, a charge controlling agent, and the like.

In a case where a toner for developing an electrostatic latent image is produced by an emulsification aggregation process, a production process by a preferable embodiment includes:

(a) a step of preparing a crystalline polyester resin particle-dispersion liquid, an amorphous resin particle-dispersion liquid, a colorant particle-dispersion liquid, and a mold release agent particle-dispersion liquid (hereinafter also referred to as a preparation step); and (b) a step of aggregating and melt-bonding the crystalline polyester resin particle-dispersion liquid, the amorphous resin particle-dispersion liquid, the colorant particle-dispersion liquid, and the mold release agent particle-dispersion liquid by mixing (hereinafter also referred to as a aggregation-melt-bonding step).

The steps (a) and (b), and steps (c) to (g) which are optionally conducted besides these steps, will be mentioned in detail.

(a) Preparation Steps

The step (a) includes a step of preparing a crystalline polyester resin particle-dispersion liquid preparation step, a step of preparing an amorphous resin particle-dispersion liquid preparation step, a step of preparing a colorant particle-dispersion liquid, and a step of preparing a mold release agent particle-dispersion liquid.

(a-1) Step of Preparing Crystalline Polyester Resin Particle-Dispersion Liquid

The step of preparing a crystalline polyester resin particle-dispersion liquid is a step in which a crystalline polyester resin that constitutes a binder resin is synthesized, and this crystalline polyester resin is dispersed in a microparticular form in an aqueous medium to prepare a dispersion liquid of crystalline polyester resin particles. In the present invention, at least the crystalline polyester resin of the toner containing a colorant having a high resistance other than the toner containing a colorant having the lowest resistance contains the above-mentioned hybrid crystalline polyester resin. Therefore, among the crystalline polyester resin particle-dispersion liquids, for at least the dispersion liquids for toners each containing a colorant having a high resistance other than the toner containing a colorant having the lowest resistance, a dispersion liquid containing hybrid crystalline polyester resin particles is used. Hereinafter the dispersion liquids containing the hybrid crystalline polyester resin particles are also explained as crystalline polyester resin dispersion liquids.

The process for producing the crystalline polyester resin (the hybrid crystalline polyester resin) is as described above, and thus the explanation thereof is omitted here.

Examples of the crystalline polyester resin particle-dispersion liquid include a process for conducting a dispersion treatment in an aqueous medium without using a solvent, or a process in which a crystalline polyester resin is dissolved in a solvent such as ethyl acetate or methyl ethyl ketone to give a solution, the solution is emulsification-dispersed in an aqueous medium by using a dispersion machine, and a desolvation treatment is conducted.

In the present invention, "an aqueous medium" refers to a medium containing at least 50% by mass or more of water, and examples of the components other than water can include organic solvents that dissolve in water such as methanol, ethanol, isopropanol, acetone, dimethylformamide, methylcellosolve, and tetrahydrofuran. Among these, alcohol-based organic solvents such as methanol, ethanol, and isopropanol, which are organic solvents that do not dissolve resins, are preferably used. Preferably, only water is used as the aqueous medium.

In a case where the crystalline polyester resin contains carboxy groups in the structure thereof, ammonia, hydroxide sodium, or the like may be added so that the carboxy groups are ionized and the resin is stably emulsified in an aqueous phase to thereby promote the emulsification smoothly. Furthermore, a dispersion stabilizer may be dissolved in an aqueous medium, and a surfactant, resin particles or the like may be added for the purpose of improving the dispersibility of oil droplets.

As the dispersion stabilizer, known dispersion stabilizers can be used, and for example, it is preferable to use a dispersion stabilizer being soluble in acids or alkalis such as calcium triphosphate, and from the viewpoint of an environmental aspect, it is preferable to use a dispersion stabilizer that can be decomposed by an enzyme. As the surfactant, known anionic surfactants, cationic surfactants, nonionic surfactants, and amphoteric surfactants can be used. Furthermore, examples of the resin particles for improving dispersion stability include polymethyl methacrylate resin particles, polystyrene resin particles, polystyrene-acrylonitrile resin particles, and the like.

Such dispersion treatment mentioned above can be conducted by utilizing a mechanical energy, and the dispersion machine is not specifically limited and examples include a homogenizer, a low-speed shear type dispersion machine, a high-speed shear type dispersion machine, a friction type dispersion machine, a high pressure jet type dispersion machine, an ultrasonic dispersion machine, a high pressure impact type dispersion machine ultimizer, an emulsification dispersion machine, and the like.

During the dispersion, it is preferable to heat the solution. The heating condition is not specifically limited, and is generally about 60 to 200° C.

The median diameter on volume basis of the crystalline polyester resin particle in the crystalline polyester resin particle-dispersion liquid prepares as above is preferably 60 to 1,000 nm, and more preferably 80 to 500 nm. This median diameter can be controlled by the magnitude of the mechanical energy during the emulsification dispersion.

Furthermore, the content of the crystalline polyester resin particles in the crystalline polyester resin particle-dispersion liquid is preferably in the range of 10 to 50% by mass, and more preferably in the range of 15 to 40% by mass with respect to the entirety of the dispersion liquid. In such a range, the extension of the particle size distribution can be suppressed, and the toner property can be improved.

(a-2) Step of Preparing Amorphous Resin Particle-Dispersion Liquid

In the step of preparing the amorphous resin particle-dispersion liquid, an aqueous dispersion liquid of the aqueous dispersion liquid and/or an aqueous dispersion liquid of the vinyl resin is prepared. Since a similar process to that mentioned in the above-mentioned (a-1) is used in the process for preparing an amorphous polyester resin, the detailed explanation is omitted here. The process for preparing the vinyl resin particle-dispersion liquid preparation (preparation step) is explained below.

In the step of preparing the vinyl resin particle-dispersion liquid, an aqueous dispersion liquid of a vinyl resin is prepared. For example, emulsification polymerization is conducted in an aqueous medium, and in a case where a vinyl resin is obtained, the liquid after the polymerization reaction can be directly used as a vinyl resin particle-dispersion liquid.

Alternatively, a process in which the isolated vinyl resin is pulverized as necessary, and the vinyl resin is dispersed in an aqueous medium in the presence of a surfactant by using a ultrasonic dispersion machine and the like can be used. Since the specific examples of the above-mentioned aqueous medium and the above-mentioned surfactant are similar to those exemplified in the above-mentioned (a-1), the explanation is omitted.

The median diameter on volume basis of the vinyl resin particles in the vinyl resin particle-dispersion liquid is preferably 60 to 1000 nm, and preferably in the range of 80 to 500 nm. This median diameter can be controlled by the magnitude of the size of the mechanical energy during the polymerization, and the like.

The content of the vinyl resin particles in the vinyl resin particle-dispersion liquid is set to be preferably in the range of 10 to 50% by mass, and more preferably in the range of 15 to 40% by mass with respect to the entirety of the dispersion liquid. In such a range, the extension of the particle size distribution can be suppressed, and the toner property can be improved.

(a-3) Step of Preparing Colorant Particle-Dispersion Liquid

The step of preparing a colorant particle-dispersion liquid is a step in which a colorant is dispersed in an aqueous medium in a microparticular form to prepare a dispersion liquid of colorant particles.

Since the aqueous medium is as explained in the above-mentioned (a-1), the explanation thereof is omitted here. A surfactant, resin particles and the like may be added to the aqueous medium for the purpose of improving the dispersion stability.

The colorant can be dispersed by a dispersion machine utilizing a mechanical energy, and such dispersion machine is not specifically limited and the dispersion machine explained in the above-mentioned (a-1) can be used.

The median diameter on volume basis of the colorant particles in the colorant particle-dispersion liquid is preferably in the range of 10 to 300 nm.

The content of the colorant in the colorant particle-dispersion liquid is preferably in the range of 5 to 45% by mass, and more preferably in the range of 10 to 30% by mass with respect to the entirety of the dispersion liquid. In such a range, an effect to ensure color reproducibility is obtained.

(a-4) Step of Preparing Mold Release Agent Particle-Dispersion Liquid

The step of preparing a mold release agent particle-dispersion liquid is a step in which a mold release agent is dispersed in an aqueous medium in a microparticular form to prepare a dispersion liquid of mold release agent particles.

The aqueous medium is as explained in the above-mentioned (a-1), and a surfactant, resin particles, and the like may be added to this aqueous medium for the purpose of improving the dispersion stability.

The mold release agent can be dispersed by utilizing a mechanical energy, and such dispersion machine is not specifically limited and the dispersion machine explained in the above-mentioned (a-1) can be used.

The median diameter on volume basis of the mold release agent particles in the mold release agent particle-dispersion liquid is preferably in the range of 10 to 300 nm.

The content of the mold release agent particles in the mold release agent particle-dispersion liquid is preferably in the range of 5 to 45% by mass, and more preferably in the range of 8 to 30% by with respect to the entirety of the mass dispersion liquid. In such a range, effects to prevent hot offset and ensure separation property can be obtained.

(b) Step of Aggregation-Melt-Bonding

This step of aggregation-melt-bonding is a step in which the above-mentioned crystalline polyester resin particles, amorphous resin particles, colorant particles, and mold release agent particles are aggregated in an aqueous medium, and these particles are melt-bonded simultaneously with the aggregation.

In this step, firstly, the crystalline polyester resin particle-dispersion liquid, the amorphous resin particle-dispersion liquid, the colorant particle-dispersion liquid, and the mold release agent particle-dispersion liquid are mixed, and these particles are dispersed in an aqueous medium.

Secondly, a flocculating agent is added, and the mixture is then heated at a temperature not less than the glass transition point of the amorphous resin particles to promote aggregation, and the resin particles are melt-bonded at the same time.

The flocculating agent is not specifically limited, and those selected from metal salts such as alkali metal salts and salts of Group II metals are preferably used. Examples of the metal salts include monovalent metal salts such as sodium, potassium, and lithium; bivalent metal salts such as calcium, magnesium, manganese, and copper; trivalent metal salts such as iron and aluminum; and the like. Examples of specific metal salts can include sodium chloride, potassium chloride, lithium chloride, calcium chloride, magnesium chloride, zinc chloride, copper sulfate, magnesium sulfate, manganese sulfate, and aluminum sulfate. Among these, bivalent or trivalent metal salts are specifically preferably used since aggregation can be promoted at a smaller amount. These flocculating agents can be used solely, or in combination of two or more kinds.

The use amount of the above-mentioned flocculating agent is not specifically limited, and is preferably 0.1 to 15 parts by mass, and more preferably 1 to 10 parts by mass with respect to 100 parts by mass of the solid content of the binder resin that constitute the toner particles.

In the aggregation step, it is preferable that the temperature is risen quickly by heating after adding the flocculating agent, and the temperature raising speed is preferably 0.05° C./min or more. The upper limit of the temperature raising speed is not specifically limited, and is preferably set to be 15° C./min or less from the viewpoint of suppressing the generation of coarse particles due to the progress of rapid melt-bonding. Furthermore, after the dispersion liquid for aggregation has reached a desired temperature, it is important to continue the melt-bonding by retaining the temperature of the dispersion liquid for aggregation at a predetermined time, preferably until the median diameter on volume basis becomes 4.5 to 7.0 μm.

(c) Step of Aging

This step is conducted as necessary, and in the aging step, an aging treatment in which the associated particles obtained by the aggregation-melt-bonding step are aged until they have a desired shape by means of a heat energy to form toner particles is conducted.

The aging treatment is specifically conducted by stirring a system in which the associated particles are dispersed under heating, and adjusting the heating temperature, the stirring speed, the heating time, and the like until the shape of the associated particles has a desired circularity.

(d) Step of Cooling

This step is a step of conducting a cooling treatment of the dispersion liquid of the toner particles. The condition for the cooling treatment is such that the cooling is conducted at a cooling speed of 1 to 20° C./min. The specific process for the cooling treatment is not specifically limited, and a process for cooling by introducing a coolant from the outside of a reaction container, a process for cooling by directly injecting cold water into a reaction system, and the like can be exemplified.

(e) Step of Filtration and Washing

This step is a step in which the toner particles are solid-liquid separated from the cooled dispersion liquid of the toner particles, and adhered substances such as a surfactant and a flocculating agent are removed from a toner cake obtained by the solid-liquid separation (an assembly in which the toner particles in a wet state are aggregated into a cake shape), and the toner particles are washed.

For the solid-liquid separation, a reduced pressure filtration process that is conducted by using a centrifugation separation process, a nutche, or the like, a filtration process that is conducted by using a filter press or the like, and the like can be used without any specific limitation.

(f) Step of Drying

This step is a step of drying a toner cake that has undergone the washing treatment, and can be conducted according to a drying step in a known method for producing toner particles which is generally conducted.

Specifically, examples of the dryer used for drying the toner cake can include a spray dryer, a vacuum lyophilizer, a reduced pressure dryer, and the like, and it is preferable to use a stationary shelf dryer, a transfer shelf dryer, a fluidized bed dryer, a rotary dryer, a stirring dryer, or the like.

(g) Step of Adding External Additive

This step is a step that is conducted as necessary in a case where an external additive is added to the toner particles.

As a device for mixing the external additive, mechanical mixing devices such as a Henschel mixer, a coffee mill, and a sample mill can be used.

<Developer>

Each of the above-mentioned toners containing colorants of respective colors can be used as a magnetic or non-magnetic one-component developer, or may be used as a two-component developer by mixing with a carrier. In a case where the toner is used as a two-component developer, magnetic particles formed of conventionally-known materials such as metals such as iron, ferrite and magnetite, and alloys of those metals with metals such as aluminum and lead can be used as a carrier, and ferrite particles are specifically preferable. Furthermore, as the carrier, a coat carrier in which the surfaces of magnetic particles are coated with a coating agent such as a resin, dispersion type carriers formed by dispersing a magnetic body micropowder in a binder resin, and the like may be used.

The volume average particle diameter of the carrier is preferably 20 to 100 μm, and more preferably 25 to 80 μm. The volume average particle diameter of the carrier can be measured typically by a laser diffraction type particle size distribution measurement device equipped with a wet dispersion machine "HELOS" (manufactured by Sympatecs).

The two-component developer can be prepared by mixing the above-mentioned carrier and toner by using a mixing device. Examples of the mixing device include a Henschel mixer, a Nauta mixer, a V-shaped mixer, and the like.

The amount of the toner blended in the preparation of the two-component developer in the present invention is preferably 1 to 10% by mass with respect to 100% by mass in total of the carrier and the toner.

<Color Image Forming Process>

The color image forming process of the present invention includes forming an image formation layer by using the above-mentioned colorant-containing toners of respective colors (toners for developing an electrostatic latent image) on a recording medium. That is, the present invention provides a color image forming process using colorant-containing toners of multiple colors containing colorants having respectively different resistances, wherein the above-mentioned colorant-containing toners (a yellow toner (Y), a magenta toner (M), a cyan toner (C) and a black toner (K)) each contain an amorphous resin, a crystalline polyester resin, and a mold release agent, and at least the crystalline polyester resin contained in the colorant-containing toner other than the colorant-containing toner containing a colorant having the lowest resistance contains a hybrid crystalline polyester resin formed by bonding a crystalline polyester polymerized segment and an amorphous polymerized segment, and the content of the amorphous polymerized segment in the hybrid crystalline polyester resin contained in the colorant-containing toner other than the toner containing a colorant having the lowest resistance is greater than the content of the amorphous polymerized segment in the crystalline polyester resin contained in the toner containing a colorant having the lowest resistance.

The color image forming process of the present invention is a process in which four kinds of toners: a black toner (K), which is preferable as toner containing a colorant having the lowest resistance among the colorant-containing toners having different resistances, and a yellow toner (Y), a magenta toner (M), and a cyan toner (C), which are preferable as the toners each containing a colorant having a high resistance, and thus can be preferably used for a full-color image forming process. In the full-color image forming process, any color image forming process such as a process using a 4-cycle system image formation device including four kinds of color developing devices of yellow, magenta, cyan, and black, respectively, and one electrostatic latent image carrier (also referred to as "electrophotographic photosensitive body" or simply referred to as "photosensitive body"), a process using a tandem system image formation device in which color developing devices for respective colors and image formation units each having an electrostatic latent image carrier for the respective colors are installed, and the like.

As the color image forming process, an image forming process including a step of fixing by means of a heat-pressure fixing system capable of imparting a pressure and conducting heating is preferable.

In this color image forming process, specifically, for example, an electrostatic latent image formed on a photosensitive body is developed onto a photosensitive body by using the above-mentioned toners to form a toner image, this toner image is transferred to an image substrate, and the toner image that has transferred onto the image substrate is then fixed on the image substrate by a fixing treatment by a heat-pressure fixing system, whereby a printed product on which a visible image has been formed can be obtained.

The imparting of a pressure and the heating in the fixing step are preferably conducted simultaneously, or a pressure may be imparted firstly and then the heating may be conducted.

In the color image forming process of the present invention, as the colorant-containing toner of multiple colors containing colorants respectively having different resistances, a color toner set having at least four kinds of toners of a yellow toner, a magenta toner, a cyan toner, and a black toner as colorant-containing toners having multiple colors containing colorants having respectively different resistances, wherein the four kinds of toners each contain an amorphous resin, a crystalline polyester resin, and a mold release agent, at least the crystalline polyester resin contained in the colorant-containing toner other than the colorant-containing toner containing a colorant having the lowest resistance contains a hybrid crystalline polyester resin formed by bonding a crystalline polyester polymerized segment and an amorphous polymerized segment, and the content of the amorphous polymerized segment in the hybrid crystalline polyester resin contained in each of the yellow toner, the magenta toner and the cyan toner as the colorant-containing toners other than the colorant-containing toner containing at least a colorant having the lowest resistance is greater than the content of the amorphous polymerized segment in the crystalline polyester resin contained in the black toner as a colorant-containing toner containing a colorant having the lowest resistance, can be used. By using such a color toner set, the transfer property under a high temperature-high humidity environment can be improved while maintaining a fine low temperature fixing property.

Furthermore, the color image forming process of the present invention is preferably used in an image forming process by a heat-pressure fixing system. As the fixing device for the heat-pressure fixing system used in the color image forming process of the present invention, known various fixing devices can be adopted. A fixing device of a thermal roller system and a fixing device of a belt heating system are explained below as the heat-pressure fixing devices.

(i) Fixing Device of Thermal Roller System

The fixing device of a thermal roller system generally has a pair of rollers including a heating roller and a pressurizing roller abutting to this heating roller. In the fixing device, the pressurizing roller is deformed by a pressure applied to between the heating roller and the pressurizing roller, whereby a so-called fixing nip part is formed in this deformed part.

The heating roller is generally formed by installing a heat source such as a halogen lamp inside of a core metal formed of a hollow metal roller formed of aluminum or the like. In the heating roller, the core metal is heated by the heat source. At this time, the energization of the heat source is controlled so that the outer periphery surface of the heating roller is maintained at a predetermined fixing temperature, whereby the temperature is adjusted.

In a case where the fixing device is used in an image formation device for forming a full-color image, for which an ability to mix colors by sufficiently heat-melting toner images formed of four toner layers (yellow, magenta, cyan, and black) is required, it is preferable that the fixing device has the following constitution. Specifically, it is preferable that the fixing device has a core metal having a high heat capacity as a heating roller, the core metal having an elastic layer for evenly melting the toner images formed on the outer periphery surface.

Furthermore, the pressurizing roller has an elastic layer formed of a soft rubber such as a urethane rubber, a silicon rubber, or the like.

As the pressurizing roller, a pressurizing roller having a core metal formed of aluminum or the like, the core metal having an elastic layer formed on the outer periphery surface thereof, may be used.

Furthermore, in a case where the pressurizing roller has a core metal, a heat source such as a halogen lamp may be disposed inside of the core metal as in the heating roller. Furthermore, the constitution may be a constitution such that the energization of the heat source is controlled so that the outer periphery surface of the pressurizing roller is maintained at a predetermined fixing temperature, whereby the temperature is adjusted.

As these heating roller and/or pressurizing roller, those having, as the outermost layer thereof, a mold release layer formed of a fluorine resin such as a polytetrafluoroethylene (PTFE) or a tetrafluoroethylene-perfluoroalkyl vinyl ether copolymer (PFA) are preferably used.

In the fixing device having such a thermal roller system, the pair of rollers are rotated to allow the fixing nip part to sandwich and convey an image substrate on which a visible image is to be formed to conduct heating by the heating roller and impart a pressure by the fixing nip part, whereby an unfixed toner image is fixed on the image substrate.

The image forming process of the present invention has a feature that the low temperature fixing property is also fine. Therefore, in the above-mentioned fixing device of a thermal roller system, the temperature of the heating roller can be relatively low, and specifically can be 150° C. or less. Furthermore, the temperature of the heating roller is preferably 140° C. or less, and more preferably 135° C. or less. From the viewpoint that the low temperature fixing property is excellent, a lower temperature of the heating roller is more preferable, and the lower limit value thereof is not specifically limited and is substantially about 90° C.

(ii) Fixing Device of Belt Heating System

A fixing device of a belt heating system generally includes, for example, a heating body formed of a ceramic heater, a pressurizing roller, and a fixing belt formed of a heat-resistant belt, which is sandwiched between these heating body and pressurizing roller, wherein the pressurizing roller is deformed by a pressure applied to between the heating body and the pressurizing roller, whereby a so-called fixing nip part is formed on this deformed part.

As the fixing belt, heat-resistance belts and sheets and the like formed of a polyimide and the like are used. Furthermore, the fixing belt may have a constitution including any of heat-resistant belts and sheets and the like formed of a polyimide as a substrate, and a mold release layer formed of a fluorine resin or the like such as a polytetrafluoroethylene (PTFE) or a tetrafluoroethylene-perfluoroalkyl vinyl ether copolymer (PFA) on the substrate is formed on the base body, and may also have a constitution further having an elastic layer formed of a rubber or the like is disposed between the substrate and the mold release layer.

In such a fixing device having of a belt heating system, an image substrate on which an unfixed toner image is allowed to be sandwiched between the fixing belt and the pressurizing roller that form a fixing nip part and conveyed. By this way, the heating body via the fixing belt is heated, and a pressure is imparted to the fixing nip part, and thus a fixed toner image is fixed on the image substrate.

According to such a fixing device of a belt heating system, it is sufficient that the heating body is energized during only formation of an image to put the heating body into a state that heat is generated at a predetermined fixing temperature. Therefore, the waiting time from the input of the power source of the image formation device to the time when the image formation device has put into a state that image formation is operable can be shortened. Furthermore, the consumed electrical power during the stand-by of the image formation device is extremely low, and thus the image formation device has advantages that power saving is attained, and the like.

As mentioned above, it is preferable that the heating body, pressurizing roller, and fixing belt used as the fixing elements in the fixing step are those having multiple layer constitutions.

In the fixing device of the above-mentioned belt heating system, the temperature of the heating body can be relatively low, and the temperature can be specifically 150° C. or less. Furthermore, the temperature of the heating body is preferably 140° C. or less, and more preferably 135° C. or less. From the viewpoint of an excellent low temperature fixing property, a lower temperature of the heating body is more preferable, and the lower limit value of the temperature is not specifically limited and is substantially about 90° C.

(Recording Medium)

The recording medium (also referred to as a recording material, a recording paper, a recording sheet or the like) may be a generally used recording medium, and is not specifically limited as long as it retains a toner image that has been formed by a known image forming process by means of an image formation device or the like. Examples of the recording medium that can be used as an image substrate include regular paper from thin paper to cardboards, high quality paper, art paper or coated printing paper such as coated paper, commercially available Japanese paper and postcard paper, OHP plastic films, fabrics, and various resin materials for use in soft packaging, or resin films, labels and the like obtained by molding the resin materials into film shapes.

The embodiments of the present invention have been explained above. However, the present invention is not limited to the above-mentioned embodiments, and can be variously modified.

EXAMPLES

The effect of the present invention will be explained by using the following Examples and Comparative Examples. In the following Examples, unless otherwise mentioned, "part" and "%" respectively mean "parts by mass" and "% by mass", and the respective operations were conducted at room temperature (in the range of 25° C.±3° C.). It should be noted that the present invention is not limited to the following Examples.

<Respective Analysis Conditions>

[Glass Transition Temperature of Amorphous Resin and Melting Point of Crystalline Resin]

The glass transition temperatures (Tg) of an amorphous polyester resin and a vinyl resin (styrene-acrylic resin) were measured by using "Diamond DSC" (manufactured by Perkin Elmer). Firstly, 3.0 mg of a measurement sample (resin) was enclosed in an aluminum pan, and the aluminum pan was set in a sample holder of "Diamond DSC". An empty aluminum pan was used as a reference. Furthermore, a DSC curve was obtained by measurement conditions (temperature raising/cooling conditions) conducting a first temperature raising process in which the temperature is raised at a temperature raising speed of 10° C./min from 0° C. to 200° C., a cooling process in which cooling is conducted at a cooling speed of 10° C./min from 200° C. to 0° C., and a second temperature raising process in which the temperature is raised at a temperature raising speed of 10° C./min from 0° C. to 200° C. in this order. Based on the DSC curve obtained by this measurement, an extended line of the base line before the rising of the first endothermic peak in that second temperature raising process and a tangent line showing the maximum gradient between the rising part of the first peak and the peak top were drawn, and the intersection point thereof was deemed as a glass transition temperature (Tg).

Furthermore, the melting point of the crystalline polyester resin (including a hybrid resin) was obtained, based on a DSC curve obtained in a similar manner to that mentioned above, by setting the temperature of the peak top of an endothermic peak (an endothermic peak having a half width within 15° C.) derived from the crystalline resin in the second temperature raising process as a melting point (Tc).

[Weight Average Molecular Weight and Number Average Molecular Weight of Resin]

The molecular weights (weight average molecular weight and number average molecular weight) of each resin by GPC were measured as follows. That is, using a device "HLC-8120GPC" (manufactured by Tosoh Corporation) and a column "TSK guard column+TSK gel Super HZ-M Triple" (manufactured by Tosoh Corporation), tetrahydrofuran (THF) was flown as a carrier solvent at a flow speed of 0.2 mL/min while retaining the column temperature at 40° C. The measurement sample (resin) was dissolved in tetrahydrofuran so that the concentration became 1 mg/ml. The solution was prepared by conducting a treatment by using an ultrasonic dispersion machine at room temperature for 5 minutes. Subsequently, the solution was treated by a membrane filter having a pore size of 0.2 μm to give a sample solution, and 10 μL of this sample solution was injected into the device together with the above-mentioned carrier solvent and detected by using a refractive index detector (RI detector). Based on a calibration curve prepared by monodispersed polystyrene standard particles, the molecular weight distribution of the measurement sample was calculated. Ten kinds of polystyrenes were used for the above-mentioned calibration curve measurement.

<Preparation of Respective Dispersion Liquids>

[Synthesis of Amorphous Polyester Resin 1 [AP Resin 1]]

The following monomers for an amorphous polyester resin were put into a four-necked flask equipped with a nitrogen introduction tube, a dehydration tube, a stirrer, and a thermocouple, and dissolved by heating to 170° C.

| | |
|---|---|
| Fumaric acid | 47.4 parts by mass |
| Telephthalic acid | 66.9 parts by mass |
| Bisphenol A-propylene oxide 2 mol adduct | 228.6 parts by mass |
| Bisphenol A-ethylene oxide 2 mol adduct | 57.1 parts by mass |

Under stirring, 0.4 parts by mass of tetra-n-butyl titanate (tetrabutyl orthotitanate) (hereinafter also abbreviated as Ti(O-n-Bu)$_4$) was injected. Under a nitrogen gas airflow, the mixture was reacted at 235° C. for 6 hours, then cooled to 200° C., further reacted under a reduced pressure (20 kPa) for 5 hours, and the solvent was then removed, whereby Amorphous Polyester Resin 1 [AP Resin 1] was obtained.

The obtained amorphous polyester resin [AP Resin 1] had a weight average molecular weight (Mw) of 35,000, and had a glass transition temperature (Tg) of 58° C.

[Preparation of Amorphous Polyester Resin Particle-Dispersion Liquid 1 [AP Dispersion Liquid 1]]

The above-mentioned Amorphous Polyester Resin 1 [AP Resin 1] (100 parts by mass) was dissolved in 400 parts by mass of ethyl acetate, the solution was mixed with 638 parts by mass of a sodium laurylsulfate solution having a concentration of 0.26% by mass, which had been prepared in advance, the mixed liquid was subjected to ultrasonic dispersion under stirring with a ultrasonic homogenizer "US-150T" (manufactured by Nihonseiki Kaisha Ltd.) at V-LEVEL 300 μA for 30 minutes, and the ethyl acetate was completely removed by using a diaphragm vacuum pump "V-700" (manufactured by BUCHI) under a state heated to 40° C. and a reduced pressure with stirring for 3 hours, whereby Amorphous Polyester Resin Dispersion Liquid 1 [AP Dispersion Liquid 1] having a solid content amount of 13.5% by mass was prepared. For the obtained Amorphous Polyester Resin Particle-Dispersion Liquid 1 [AP Dispersion Liquid 1], the amorphous polyester resin particles had an average particle size (a median diameter on volume basis) of 110 nm. The median diameter on volume basis (D50) of the amorphous polyester resin particles was measured by a microtrack particle size distribution meter "UPA-150" (manufactured by Nikkiso Co., Ltd.).

[Preparation of Amorphous Resin Particle-Dispersion Liquid 1 formed of Styrene-Acrylic Resin [SA Dispersion Liquid 1]]

(First Stage Polymerization)

Eight parts by mass of sodium dodecylsulfate and 3,000 parts by mass of ion exchanged water were charged in a 5 L reaction container equipped with a stirrer, a temperature sensor, a cooling tube, and a nitrogen introduction device, and the internal temperature was raised to 80° C. while the mixture was stirred under a nitrogen airflow at a stirring speed of 230 rpm. After the temperature raising, a solution obtained by dissolving 10 parts by mass of potassium persulfate in 200 parts by mass of ion exchanged water was added, the liquid temperature was set to 80° C. again, and a mixed liquid of the following monomers was added dropwise over 1 hour.

| | |
|---|---|
| Styrene | 480.0 parts by mass |
| n-Butyl acrylate | 250.0 parts by mass |
| Methacrylic acid | 68.0 parts by mass |
| n-Octylmercaptane | 16.4 parts by mass |

After the dropwise addition, polymerization was conducted by stirring the mixture under heating at 80° C. for 2 hours, whereby Amorphous Resin Dispersion Liquid A formed of a styrene-acrylic resin was prepared.

(Second Stage Polymerization)

A solution obtained by dissolving 7 parts by mass of sodium dodecylsulfate in 3,000 parts by mass of ion exchanged water was charged in a 5 L reaction container equipped with a stirrer, a temperature sensor, a cooling tube, and a nitrogen introduction device, and heated to 98° C. After the heating, 300 parts by mass in terms of solid content of Amorphous Resin Dispersion Liquid A formed of a styrene-acrylic resin, which has been prepared by the above-mentioned first stage polymerization, and a mixed liquid obtained by dissolving the following monomer, chain transfer agent, and mold release agent at 90° C. were added.

| | |
|---|---|
| Styrene | 243.0 parts by mass |
| n-Butyl acrylate | 45.5 parts by mass |
| 2-Ethylhexyl acrylate | 45.5 parts by mass |
| Methacrylic acid | 33.1 parts by mass |
| n-Octylmercaptane (chain transfer agent) | 5.5 parts by mass |
| Behenyl behenate (mold release agent, melting point: 73° C.) | 130.0 parts by mass |

By means of a mechanical dispersion machine having a circulation pathway CLEARMIX (manufactured by M Technique Co., Ltd.), a mixing-dispersion treatment was conducted for 1 hour to prepare a dispersion liquid containing emulsification particles (oil droplets). A solution of a polymerization initiator obtained by dissolving 6 parts by mass of potassium persulfate in 200 parts by mass of ion exchanged water was added to this dispersion liquid, and this system was polymerized by stirring under heating at 78° C. over 1 hour, whereby Amorphous Resin Dispersion Liquid B formed of a styrene-acrylic resin was prepared.

(Third Stage Polymerization)

To Amorphous Resin Dispersion Liquid B formed of a styrene-acrylic resin obtained by the above-mentioned second stage polymerization was further added 400 parts by mass of ion exchanged water, the mixture was thoroughly mixed, and a solution obtained by dissolving 6.0 parts by mass of potassium persulfate in 400 parts by mass of ion exchanged water was added. Furthermore, a mixed liquid of the following monomers and a chain transfer agent was added dropwise over 1 hour under a temperature condition of 81° C.

| | |
|---|---|
| Styrene | 354.8 parts by mass |
| n-Butyl acrylate | 143.2 parts by mass |
| Methacrylic acid | 52.0 parts by mass |
| n-Octylmercaptane (chain transfer agent) | 8.0 parts by mass |

After the completion of the dropwise addition, polymerization was conducted by stirring the mixture under heating over 2 hours, and the product was cooled to 28° C., whereby Amorphous Resin Particle-Dispersion Liquid 1 formed of a styrene-acrylic resin [SA Dispersion Liquid 1] was prepared.

The obtained Amorphous Resin Particle-Dispersion Liquid 1 formed of a styrene-acrylic resin [SA Dispersion Liquid 1] had a median diameter on volume basis of the amorphous resin particles formed of a styrene-acrylic resin of 120 nm, a glass transition temperature (Tg) of 59° C., and a weight average molecular weight (Mw) of 32,000. The median diameter on volume basis (D50) of the amorphous resin particles formed of a styrene-acrylic resin was measured by a microtrack particle size distribution measurement device "UPA-150" (manufactured by Nikkiso Co., Ltd.).

[Preparation of Black Colorant Particle-Dispersion Liquid [Bk]]

Sodium dodecylsulfate (90.0 parts by mass) was added to 1,600.0 parts by mass of ion exchanged water. While this solution was stirred, 320.0 parts by mass of carbon black "Regal (registered trademark) 330R" (manufactured by Cabot) was gradually added, and the mixture was subjected to a dispersion treatment by using a stirrer "Clearmix" (manufactured by M Technique Co., Ltd.), whereby Black Colorant Particle-Dispersion Liquid [Bk] was prepared.

For the obtained Black Colorant Particle-Dispersion Liquid [Bk], the black colorant particles had an average particle size (a median diameter on volume basis) of 110 nm.

[Preparation of Yellow Colorant Particle-Dispersion Liquid [Ye]]

Sodium dodecylsulfate (95.0 parts by mass) was added to 1,600.0 parts by mass of ion exchanged water. While this solution was stirred, 250.0 parts by mass of C. I. Pigment Yellow 74 was gradually added, and the mixture was subjected to a dispersion treatment by using a stirrer "Clearmix" (manufactured by M Technique Co., Ltd.), whereby Yellow Colorant Particle-Dispersion Liquid [Ye] was prepared.

For the obtained Yellow Colorant Particle-Dispersion Liquid [Ye], the yellow colorant particles had an average particle size (a median diameter on volume basis) of 120 nm.

[Preparation of Magenta Colorant Particle-Dispersion Liquid [Ma]]

Sodium dodecylsulfate (95.0 parts by mass) was added to 1,600.0 parts by mass of ion exchanged water. While this solution was stirred, 250.0 parts by mass of C. I. Pigment Red 122 was gradually added, and the mixture was subjected to a dispersion treatment by using a stirrer "Clearmix" (manufactured by M Technique Co., Ltd.), whereby Magenta Colorant Particle-Dispersion Liquid [Ma] was prepared.

For the obtained Magenta Colorant Particle-Dispersion Liquid [Ma], the magenta colorant particles had an average particle size (a median diameter on volume basis) of 115 nm.

[Preparation of Cyan Colorant Particle-Dispersion Liquid [Cy]]

Sodium dodecylsulfate (90.0 parts by mass) was added to 1,600.0 parts by mass of ion exchanged water. While this solution was stirred, 420.0 parts by mass of C. I. Pigment Blue 15:3 was gradually added, and the mixture was subjected to a dispersion treatment by using a stirrer "Clearmix" (manufactured by M Technique Co., Ltd.), whereby Cyan Colorant Particle-Dispersion Liquid [Cy] was prepared.

For the obtained Cyan Colorant Particle-Dispersion Liquid [Cy], the cyan colorant particles had an average particle size (a median diameter on volume basis) of 110 nm.

All of the average particle sizes (median diameters on volume basis) of the respective color colorant particles in Black Colorant Particle-Dispersion Liquid [Bk], Yellow Colorant Particle-Dispersion Liquid [Ye], Magenta Colorant Particle-Dispersion Liquid [Ma], and Cyan Colorant Particle-Dispersion Liquid [Cy] were measured by "MICROTRAC UPA-150" (manufactured by HONEYWELL).

[Synthesis of Hybrid Crystalline Polyester Resin 1 [HBCP Resin 1]]

A mixed liquid of the following monomers for a styrene-acrylic resin, a monomer having a substituent that reacts with both of a crystalline polyester resin and a styrene-acrylic resin, and a polymerization initiator was put into a dropping funnel.

| | |
|---|---|
| Styrene | 6.0 parts by mass |
| n-Butyl acrylate | 1.4 parts by mass |
| Acrylic acid | 0.8 parts by mass |
| Di-t-butyl peroxide (polymerization initiator) | 7.0 parts by mass |

Furthermore, the following monomers for a crystalline polyester resin were put into a four-necked flask equipped with a nitrogen introduction tube, a dehydration tube, a stirrer and a thermocouple, and dissolved by heating to 170° C.

| | |
|---|---|
| Dodecane diacid | 480.0 parts by mass |
| 1,6-Hexanediol | 296.0 parts by mass |

Under stirring, a mixed liquid in a dropping funnel was added dropwise to a four-necked flask over 90 minutes and aged for 60 minutes, and the reacted monomers were removed under a reduced pressure (8 kPa). Subsequently, 0.8 parts by mass of Ti $(O\text{-}n\text{-}Bu)_4$ was added as an esterification catalyst, and a reaction was conducted under an ordinary pressure (101.3 kPa) for 5 hours, and under a reduced pressure (8 kPa) for further 1 hour with raising the temperature to 235° C.

Subsequently, the temperature was cooled to 200° C., a reaction was conducted under a reduced pressure (20 kPa), whereby Hybrid Crystalline Polyester Resin 1 modified with a styrene-acrylic resin [HBCP Resin 1] was obtained. The obtained Hybrid Crystalline Polyester Resin 1 [HBCP Resin 1] had a weight average molecular weight (Mw) of 23,500 and a melting point (mp) of 73° C.

[Preparation of Hybrid Crystalline Polyester Resin Particle-Dispersion Liquid 1 [HBCP Dispersion Liquid 1]]

Hybrid Crystalline Polyester Resin 1 [HBCP Resin 1] (30 parts by mass) was melted, and transferred to an emulsification dispersion machine "Cavitron CD1010" (manufactured by Eurotec) with keeping the molten state at a transfer speed of 100 parts by mass per minute. Furthermore, simultaneously with this transfer of Hybrid Crystalline Polyester Resin 1 [HBCP Resin 1] in this molten state, an aqueous diluted ammonia having a concentration of 0.37% by mass obtained by diluting 70 parts by mass of a reagent aqueous ammonia with ion exchanged water in an aqueous solvent tank was transferred to the emulsification dispersion machine at a transfer speed of 0.1 liters per minute with heating to 100° C. in a heat exchanger. Furthermore, this emulsification dispersion machine was operated under conditions of a rotation speed of a rotor of 60 Hz and a pressure of 5 kg/cm', whereby Hybrid Crystalline Polyester Resin Particle-Dispersion Liquid 1 [HBCP Dispersion Liquid 1] was prepared. The hybrid crystalline polyester resin particles in the obtained [HBCP Dispersion Liquid 1] had a median diameter on volume basis of 160 nm. The above-mentioned median diameter on volume basis (D50) was measured by a microtrack particle size distribution measurement device "UPA-150" (manufactured by Nikkiso Co., Ltd.) (the same applies hereinafter).

[Synthesis of Hybrid Crystalline Polyester Resins 2 to 7 [HBCP Resins 2 to 7]]

Hybrid Crystalline Polyester Resins 2 to 7 [HBCP Resins 2 to 7] were obtained in a similar manner to the above-mentioned synthesis of Hybrid Crystalline Polyester Resin 1 [HBCP Resin 1], except that the amounts of the respective monomers were changed as shown in the following Table 1 in the synthesis of the above-mentioned Hybrid Crystalline Polyester Resin 1 [HBCP Resin 1]. The weight average molecular weights (Mw) and melting points (mp) of the obtained Hybrid Crystalline Polyester Resins 2 to 7 [HBCP Resins 2 to 7] are shown in the following Table 1.

TABLE 1

| Hybrid Crystalline Polyester Resin | Amount of Amorphous Polymerized Segment in Hybrid Crystalline Polyester Resin (% by mass) | Styrene (part by mass) | n-Butyl acrylate (part by mass) | Acrylic acid (part by mass) | Dodecane diacid (part by mass) | 1,6-hexanediol (part by mass) | Weight Average Molecular Weight (Mw) | Melting Point (mp) (° C.) |
|---|---|---|---|---|---|---|---|---|
| HBCP Resin 1 | 1.0 | 6.0 | 1.4 | 0.8 | 480.0 | 296.0 | 23500 | 73 |
| HBCP Resin 2 | 2.0 | 11.0 | 3.0 | 1.5 | 480.0 | 296.0 | 25000 | 74 |
| HBCP Resin 3 | 3.0 | 17.5 | 4.3 | 2.2 | 480.0 | 296.0 | 24000 | 72 |
| HBCP Resin 4 | 6.0 | 36.0 | 9.0 | 4.8 | 480.0 | 296.0 | 26500 | 76 |
| HBCP Resin 5 | 10.0 | 26.0 | 6.5 | 3.3 | 200.0 | 123.3 | 25000 | 75 |
| HBCP Resin 6 | 20.0 | 59.0 | 14.7 | 7.3 | 200.0 | 123.3 | 25500 | 73 |
| HBCP Resin 7 | 25.0 | 79.0 | 20.0 | 9.0 | 200.0 | 123.3 | 26000 | 72 |

[Preparation of Hybrid Crystalline Polyester Resin Particle-Dispersion Liquids 2 to 7 [HBCP Dispersion Liquids 2 to 7]]

Hybrid Crystalline Polyester Resin Particle-Dispersion Liquids 2 to 7 [HBCP Dispersion Liquids 2 to 7] were prepared by a similar process to that in the preparation of the above-mentioned Hybrid Crystalline Polyester Resin Particle-Dispersion Liquid 1 [HBCP Dispersion Liquid 1] by using the above-mentioned Hybrid Crystalline Polyester Resins 2 to 7 [HBCP Resins 2 to 7]. The median diameters on volume basis of the hybrid crystalline polyester resin particles in the obtained hybrid crystalline polyester resin particle-dispersion liquids are shown in the following Table 2.

TABLE 2

| | Median Diameter (nm) |
|---|---|
| HBCP Dispersion Liquid 1 | 160 |
| HBCP Dispersion Liquid 2 | 180 |
| HBCP Dispersion Liquid 3 | 180 |
| HBCP Dispersion Liquid 4 | 200 |
| HBCP Dispersion Liquid 5 | 200 |
| HBCP Dispersion Liquid 6 | 180 |
| HBCP Dispersion Liquid 7 | 180 |

[Synthesis of Hybrid Crystalline Polyester Resin 8 [HBCP Resin 8]]

(Preparation of Amorphous Polyester Resin 8A)

The following monomers for an amorphous polyester resin were put into a reaction equipped with a container stirrer, a nitrogen introduction tube, a temperature sensor, and a rectification column, and the temperature was raised to 190° C. over 1 hour, and it was confirmed that the inside of the reaction system was homogeneously stirred. Thereafter, 0.4 parts by mass of Ti (O-n-Bu)$_4$ was added as an esterification catalyst, and a reaction was conducted for 5 hours while the generated water was distilled off with keeping 190° C. (Amorphous Polyester Resin 8A was prepared in the reaction container).

| | |
|---|---|
| Telephthalic acid | 21.0 parts by mass |
| Fumaric acid | 1.2 parts by mass |
| Trimellitic acid | 3.2 parts by mass |
| Bisphenol A ethylene oxide 2 mol adduct | 15.0 parts by mass |
| Bisphenol A propylene oxide 2 mol adduct | 46.0 parts by mass |

(Preparation of Crystalline Polyester Resin 8C)

Furthermore, the following monomers for a crystalline polyester resin were put into a four-necked flask equipped with a nitrogen introduction tube, a dehydration tube, a stirrer, and a thermocouple, and dissolved by heating to 170° C.

| | |
|---|---|
| Dodecane diacid | 480.0 parts by mass |
| 1,6-Hexanediol | 296.0 parts by mass |

Thereafter 0.4 parts by mass of Ti (O-n-Bu)$_4$ was added as an esterification catalyst, and a reaction was conducted for 5 hours while the generated water was distilled off with keeping 170° C.

Subsequently, a reaction was conducted for 60 minutes, and the unreacted monomers were removed under a reduced pressure (8 kPa) (Crystalline Polyester Resin 8C was prepared in a four-necked flask).

(Synthesis of Hybrid Crystalline Polyester Resin 8 [HBCP Resin 8])

Thereafter, 0.8 parts by mass of Ti (O-n-Bu)$_4$ as an esterification catalyst and Amorphous Polyester Resin 8A prepared above were injected in a reaction container (a four-necked flask) in which the above-mentioned Crystalline Polyester Resin 8C had been prepared, the temperature was raised to 235° C., and a reaction was conducted under an ordinary pressure (101.3 kPa) for 5 hours, and further 1 hour under a reduced pressure (8 kPa).

The reaction container was then cooled to 200° C., and a reaction was conducted under a reduced pressure (20 kPa), whereby Hybrid Crystalline Polyester Resin 8 [HBCP Resin 8] was obtained. The obtained Hybrid Crystalline Polyester Resin 8 [HBCP Resin 8] had a weight average molecular weight (Mw) of 24,500 and a melting point (mp) of 72° C.

(Preparation of Hybrid Crystalline Polyester Resin Particle-Dispersion Liquid 8 [HBCP Dispersion Liquid 8])

Hybrid Crystalline Polyester Resin 8 [HBCP Resin 8] (30 parts by mass) was melted, and transferred to an emulsification dispersion machine "Cavitron CD1010" (manufactured by Eurotec) at a transfer speed of 100 parts by mass per minute with keeping the molten state. Furthermore, simultaneously with the transfer of Hybrid Crystalline Polyester Resin 8 [HBCP Resin 8] in this molten state, an aqueous diluted ammonia having a concentration of 0.37% by mass obtained by diluting 70 parts by mass of a reagent aqueous ammonia with ion exchanged water in an aqueous solvent tank was transferred to the emulsification dispersion machine at a transfer speed of 0.1 liters per minute with heating to 100° C. in a heat exchanger. Furthermore, this emulsification dispersion machine was operated under conditions of a rotation speed of rotor of 60 Hz and a pressure of 5 kg/cm', whereby Hybrid Crystalline Polyester Resin Particle-Dispersion Liquid 8 [HBCP Dispersion Liquid 8] was prepared. The hybrid crystalline polyester resin particles in the obtained [HBCP Dispersion Liquid 8] had a median diameter on volume basis of 180 nm.

[Synthesis of (Non-hybrid) Crystalline Polyester Resin 1 [CP Resin 1]]

The following monomers for a crystalline polyester resin were put into a four-necked flask equipped with a nitrogen introduction tube, a dehydration tube, a stirrer, and a thermocouple, and dissolved by heating to 170° C.

| | |
|---|---|
| Dodecane diacid | 440.0 parts by mass |
| 1,6-Hexanediol | 173.0 parts by mass |

Subsequently, 0.8 parts by mass of Ti $(O\text{-}n\text{-}Bu)_4$ was added as an esterification catalyst, and a reaction was conducted for 5 hours, the temperature was raised to 235° C., and a reaction was conducted under an ordinary pressure (101.3 kPa) for 5 hours, and under a reduced pressure (8 kPa) for further 1 hours.

Subsequently, the temperature was cooled to 200° C., and a reaction was conducted under a reduced pressure (20 kPa), whereby Crystalline Polyester Resin 1 [CP Resin 1] was obtained. The obtained Crystalline Polyester Resin 1 [CP Resin 1] had a weight average molecular weight (Mw) of 21,000 and a melting point (mp) of 73° C.

(Preparation of Crystalline Polyester Resin Particle-Dispersion Liquid 1 [CP Dispersion Liquid 1])

Crystalline Polyester Resin 1 [CP Resin 1] (100 parts by mass) was dissolved in 400 parts by mass of ethyl acetate, and the solution was mixed with 638 parts by mass of a sodium laurylsulfate solution having a concentration of 0.26% by mass, which had been prepared in advance. The mixed liquid was subjected to a ultrasonic dispersion treatment under stirring with a ultrasonic homogenizer "US-150T" (manufactured by Nihonseiki Kaisha Ltd.) at V-LEVEL 300 μA for 30 minutes, and the ethyl acetate was completely removed by using a diaphragm vacuum pump "V-700" (manufactured by BUCHI) under a state heated to 40° C. and a reduced pressure with stirring for 3 hours, whereby Crystalline Polyester Resin Particle-Dispersion Liquid 1 [CP Dispersion Liquid 1] was prepared. The crystalline polyester resin particles in the Dispersion Liquid 1 [CP Dispersion Liquid 1] had a median diameter on volume basis of 160 mm.

<Measurement of Resistance of Colorant Particles>

The resistance of the colorant particles was obtained by a volume resistance rate measured by "Digital Ultra High Resistance/Minute Electrical Current Meter 5450" (manufactured by ADC Corporation). The specific process for measuring the volume resistance rate is as follows: 80 parts by mass of the colorant particles and 20 parts by mass of Amorphous Polyester Resin 1 [AP Resin 1] were mixed, these particles were molded into disc-shaped pellets each having a diameter of 35 mm and a height of 2 mm, and the pellets were measured by using the above-mentioned electrical current meter at a voltage of 500 V to obtain a volume resistance rate. The pressure at the time of molding of the pellets was 150 kN, and the pressurization time was 10 seconds. Furthermore, the above-mentioned volume resistance rate was based on the measurement value at after 3 minutes of the application of the voltage.

When the black colorant (carbon black "Regal (registered trademark) 330R" (manufactured by Cabot)) was measured, the volume resistance rate was too low to be measured. That is, it was able to be confirmed that the black colorant had a volume resistance rate of lower than $5\times10^{-2}$ Ω·cm, which is the measurement limit at the low resistance side under the above-mentioned measurement conditions of the above-mentioned measurement device. The yellow colorant (C. I. Pigment Yellow 74) had a volume resistance rate of 2.1×10" Ω·cm. The magenta colorant (C. I. Pigment Red 122) had a volume resistance rate of $1.0\times10^{15}$ Ω·cm. The cyan colorant (C. I. Pigment Blue 15:3) had a volume resistance rate of $3.1\times10^{15}$ Ω·cm.

<Preparation of Respective Toners (Developers)>

[Preparation of Black Developer [Bk1]]

To a reaction container equipped with a stirrer, a temperature sensor and a cooling tube were injected 398 parts by mass (in terms of solid content) of Amorphous Resin Particle-Dispersion Liquid 1 [SA Dispersion Liquid 1] formed of a styrene-acrylic resin, 49 parts by mass (in terms of solid content) of Hybrid Crystalline Polyester Resin Dispersion Liquid 1 [HBCP Dispersion Liquid 1], 4.47 parts by mass (in terms of solid content) of sodium dodecyldiphenyl ether disulfonate, and 2,000 parts by mass of ion exchanged water. Under room temperature (25° C.), the pH was adjusted to 10 by adding 5 mol/liter of an aqueous hydroxide sodium solution.

Furthermore, 50 parts by mass (in terms of solid content) of Black Colorant Particle-Dispersion Liquid [Bk] was injected, and an aqueous solution obtained by dissolving 60 parts by mass of magnesium chloride in 60 parts by mass of ion exchanged water was added under stirring at 30° C. over 10 minutes. After leaving 3 minutes, the temperature of this system was raised to 80° C. over 60 minutes, and when the temperature had reached 80° C., the stirring speed was adjusted so that the growth speed of the particle diameter became 0.01 μm/min, and the particles were grown by "Coulter Multicizer 3" (manufactured by Beckman Coulter) until the measured median diameter on volume basis became 6.0 μm.

Furthermore, 50 parts by mass (in terms of solid content) of Amorphous Polyester Resin Dispersion Liquid 1 [AP Dispersion Liquid 1] was injected, and an aqueous solution obtained by dissolving 190 parts by mass of sodium chloride in 760 parts by mass of ion exchanged water was added at the time point when the supernatant of the liquid had become transparent to stop the growth of the particle diameter. The temperature was further raised, and the liquid was stirred at a state of 80° C., and the melt-bonding of the particles was progressed until the average circularity of the toner particles became 0.970 by using a device for measuring the average circularity of the toner particles "FPIA-3000" (manufactured by Sysmex) (HPF detection number: 4,000), and the particles were cooled to 30° C.

Secondly, solid-liquid separation was conducted, and the dehydrated toner cake was dispersed again in ion exchanged water, and operations for solid-liquid separation were repeated three times to wash the dispersion, and the dispersion was dried at 40° C. for 24 hours to give Black Toner Particles [XBk1].

To the obtained Black Toner Particles [XBk1] (100 parts by mass) were added 0.6 parts by mass of a hydrophobic silica (number average primary particle diameter=12 nm, hydrophobicity=68) and 1.0 parts by mass of a hydrophobic titanium oxide (number average primary particle diameter=20 nm, hydrophobicity=63), the mixture was subjected to a step of treating with an external additive in which the mixture was mixed at a rotary blade circumferential speed of 35 m/sec at 32° C. for 20 minutes by using "Henschel mixer" (manufactured by Mitsui Mike Engineering Corporation), and coarse particles were removed by using a sieve with an opening of 45 μm to give Black Toner [Bk1]. The number average primary particle diameters of the above-mentioned respective external additives were obtained by the above-mentioned process.

A ferrite carrier having a volume average particle diameter 30 μm coated with a copolymerized resin of cyclohexyl methacrylate and methyl methacrylate (monomer mass ratio=1:1) was mixed with Black Toner [Bk1] so that the toner concentration became 6% by mass to give Black Developer [Bk1].

[Preparation of Black Developers [Bk2] to [Bk9]]

Black Developers [Bk2] to [Bk9] were obtained by similar procedures to that in the preparation of the above-mentioned Black Developer [Bk1], except that the kind and use amount of the dispersion liquid used instead of Hybrid Crystalline Polyester Resin Dispersion Liquid 1 [HBCP Dispersion Liquid 1] were set as shown in the following Table 3.

TABLE 3

| Black Developers | | |
|---|---|---|
| | Dispersion Liquid Used | Use Amount |
| Bk1 | HBCP Dispersion Liquid 1 | 49 parts by mass |
| Bk2 | HBCP Dispersion Liquid 2 | 49 parts by mass |

TABLE 3-continued

| Black Developers | | |
|---|---|---|
| | Dispersion Liquid Used | Use Amount |
| Bk3 | CP Dispersion Liquid 1 | 49 parts by mass |
| Bk4 | HBCP Dispersion Liquid 5 | 49 parts by mass |
| Bk5 | HBCP Dispersion Liquid 7 | 49 parts by mass |
| Bk6 | CP Dispersion Liquid 1 | 26 parts by mass |
| Bk7 | CP Dispersion Liquid 1 | 88 parts by mass |
| Bk8 | CP Dispersion Liquid 1 | 15.5 parts by mass |
| Bk9 | CP Dispersion Liquid 1 | 124.5 parts by mass |

[Preparation of Yellow Developers [Ye1] to [Ye13]]

Yellow Developers [Ye1] to [Ye13] were obtained by similar procedures to that in the preparation of the above-mentioned Black Developer [Bk1], except that the kind and use amount of the dispersion liquid used instead of Hybrid Crystalline Polyester Resin Dispersion Liquid 1 [HBCP Dispersion Liquid 1] and the kind and use amount of the colorant particle-dispersion liquid used instead of Black Colorant Particle-Dispersion Liquid [Bk] were set as shown in the following Table 4.

TABLE 4

| Yellow Developers | | | | |
|---|---|---|---|---|
| | Dispersion Liquid Used | Use Amount of Dispersion Liquid | Kind of Colorant Particle-Dispersion Liquid | Use Amount of Colorant Particle-Dispersion Liquid |
| Ye1 | HBCP Dispersion Liquid 1 | 49 parts by mass | [Ye] | 50 parts by mass |
| Ye2 | HBCP Dispersion Liquid 2 | 49 parts by mass | [Ye] | 50 parts by mass |
| Ye3 | HBCP Dispersion Liquid 3 | 49 parts by mass | [Ye] | 50 parts by mass |
| Ye4 | HBCP Dispersion Liquid 4 | 49 parts by mass | [Ye] | 50 parts by mass |
| Ye5 | HBCP Dispersion Liquid 5 | 49 parts by mass | [Ye] | 50 parts by mass |
| Ye6 | HBCP Dispersion Liquid 6 | 49 parts by mass | [Ye] | 50 parts by mass |
| Ye7 | HBCP Dispersion Liquid 7 | 49 parts by mass | [Ye] | 50 parts by mass |
| Ye8 | CP Dispersion Liquid 1 | 49 parts by mass | [Ye] | 50 parts by mass |
| Ye9 | HBCP Dispersion Liquid 5 | 26 parts by mass | [Ye] | 50 parts by mass |
| Ye10 | HBCP Dispersion Liquid 5 | 88 parts by mass | [Ye] | 50 parts by mass |
| Ye11 | HBCP Dispersion Liquid 5 | 15.5 parts by mass | [Ye] | 50 parts by mass |
| Ye12 | HBCP Dispersion Liquid 5 | 124.5 parts by mass | [Ye] | 50 parts by mass |
| Ye13 | HBCP Dispersion Liquid 8 | 49 parts by mass | [Ye] | 50 parts by mass |

[Preparation of Magenta Developers [Ma1] to [Ma12]]

Magenta Developers [Ma1] to [Ma12] were obtained by similar procedures to that in the preparation of the above-mentioned Black Developer [Bk1], except that the kind and use amount of the dispersion liquid used instead of Hybrid Crystalline Polyester Resin Dispersion Liquid 1 [HBCP Dispersion Liquid 1] and the kind and use amount of the colorant particle-dispersion liquid used instead of Black Colorant Particle-Dispersion Liquid [Bk] were set as shown in the following Table 5.

TABLE 5

| Magenta Developers | | | | |
|---|---|---|---|---|
| | Dispersion Liquid Used | Use Amount of Dispersion Liquid | Kind of Colorant Particle-Dispersion Liquid | Use Amount of Colorant Particle-Dispersion Liquid |
| Ma1 | HBCP Dispersion Liquid 1 | 49 parts by mass | [Ma] | 50 parts by mass |
| Ma2 | HBCP Dispersion Liquid 2 | 49 parts by mass | [Ma] | 50 parts by mass |
| Ma3 | HBCP Dispersion Liquid 3 | 49 parts by mass | [Ma] | 50 parts by mass |
| Ma4 | HBCP Dispersion Liquid 4 | 49 parts by mass | [Ma] | 50 parts by mass |
| Ma5 | HBCP Dispersion Liquid 5 | 49 parts by mass | [Ma] | 50 parts by mass |

TABLE 5-continued

| Magenta Developers | | | | |
|---|---|---|---|---|
| | Dispersion Liquid Used | Use Amount of Dispersion Liquid | Kind of Colorant Particle-Dispersion Liquid | Use Amount of Colorant Particle-Dispersion Liquid |
| Ma6 | HBCP Dispersion Liquid 6 | 49 parts by mass | [Ma] | 50 parts by mass |
| Ma7 | HBCP Dispersion Liquid 7 | 49 parts by mass | [Ma] | 50 parts by mass |
| Ma8 | CP Dispersion Liquid 1 | 49 parts by mass | [Ma] | 50 parts by mass |
| Ma9 | HBCP Dispersion Liquid 5 | 26 parts by mass | [Ma] | 50 parts by mass |
| Ma10 | HBCP Dispersion Liquid 5 | 88 parts by mass | [Ma] | 50 parts by mass |
| Ma11 | HBCP Dispersion Liquid 5 | 15.5 parts by mass | [Ma] | 50 parts by mass |
| Ma12 | HBCP Dispersion Liquid 5 | 124.5 parts by mass | [Ma] | 50 parts by mass |
| Ma13 | HBCP Dispersion Liquid 8 | 49 parts by mass | [Ma] | 50 parts by mass |

[Preparation of Cyan Developers [Cy1] to [Cy12]]

Cyan Developers [Cy1] to [Cy12] were obtained by similar procedures to that in the preparation of the above-mentioned Black Developer [Bk1], except that the kind and use amount of the dispersion liquid used instead of Hybrid Crystalline Polyester Resin Dispersion Liquid 1 [HBCP Dispersion Liquid 1] and the kind and use amount of the colorant particle-dispersion liquid used instead of Black Colorant Particle-Dispersion Liquid [Bk] were set as shown in the following Table 6.

TABLE 6

| Cyan Developers | | | | |
|---|---|---|---|---|
| | Dispersion Liquid Used | Use Amount of Dispersion Liquid | Kind of Colorant Particle-Dispersion Liquid | Use Amount of Colorant Particle-Dispersion Liquid |
| Cy1 | HBCP Dispersion Liquid 1 | 49 parts by mass | [Cy] | 50 parts by mass |
| Cy2 | HBCP Dispersion Liquid 2 | 49 parts by mass | [Cy] | 50 parts by mass |
| Cy3 | HBCP Dispersion Liquid 3 | 49 parts by mass | [Cy] | 50 parts by mass |
| Cy4 | HBCP Dispersion Liquid 4 | 49 parts by mass | [Cy] | 50 parts by mass |
| Cy5 | HBCP Dispersion Liquid 5 | 49 parts by mass | [Cy] | 50 parts by mass |
| Cy6 | HBCP Dispersion Liquid 6 | 49 parts by mass | [Cy] | 50 parts by mass |
| Cy7 | HBCP Dispersion Liquid 7 | 49 parts by mass | [Cy] | 50 parts by mass |
| Cy8 | CP Dispersion Liquid 1 | 49 parts by mass | [Cy] | 50 parts by mass |
| Cy9 | HBCP Dispersion Liquid 5 | 26 parts by mass | [Cy] | 50 parts by mass |
| Cy10 | HBCP Dispersion Liquid 5 | 88 parts by mass | [Cy] | 50 parts by mass |
| Cy11 | HBCP Dispersion Liquid 5 | 15.5 parts by mass | [Cy] | 50 parts by mass |
| Cy12 | HBCP Dispersion Liquid 5 | 124.5 parts by mass | [Cy] | 50 parts by mass |
| Cy13 | HBCP Dispersion Liquid 8 | 49 parts by mass | [Cy] | 50 parts by mass |

<Evaluation of Combinations of Developers of Respective Colors of Examples 1 to 18 and Comparative Examples 1 to 3 (Sets of Color Toners (Developers) by YMCK Toners))>

(1) Evaluation of Low Temperature Fixing Property

A fixing device was remodeled by using a copying machine "bizhub PRESS (registered trademark) C1070" (manufactured by Konica Minolta, Inc.) so that the surface temperature (fixing temperature) of a heating roller can be changed in the range of 120 to 180° C., and the developers having respective colors prepared above were respectively loaded by the combinations (sets of color toners (developers)) in the following Table 7, and the sets were evaluated.

Under an environment of an ordinary temperature and an ordinary humidity (temperature: 20° C., relative humidity: 50% RH), the adhesion amount of each color of YMCK toners (a yellow toner, a magenta toner, a cyan toner, and a black toner) was preset to 4.0 g/m$^2$ on A4 size high quality paper "CF paper" (manufactured by Konica Minolta Inc.), and fixing experiments for fixing a solid image of superposed four colors (in the order of YMCK) having a size of 100 mm×100 mm size were repeatedly conducted with changing the preset fixing temperature so as to increase from 120° C. to 180° C. at 1° C. intervals.

The printed products at the respective fixing temperatures obtained above were confirmed by visual observation, and the lowest temperature at which the whole toner was fixed without adhering to the fixing apparatus was deemed as the lowest fixing temperature (° C.). The results are shown in the following Table 8. The printed products having the lowest fixing temperature of 150° C. or less were judged to be acceptable.

(2) Evaluation of Image Concentration Unevenness Under High Temperature-High Humidity Environment Using a copying machine "bizhub PRESS (registered trademark) C1070" (manufactured by Konica Minolta, Inc.), the developers having respective colors prepared above were respectively loaded by the combinations (sets of color toners (developers)) in the following Table 7, and the sets were evaluated.

Halftone images of respective colors of a black toner, a yellow toner, a magenta toner, and cyan toner were formed under an environment of a high temperature and a high humidity (temperature 30° C., relative humidity 80% RH)

on A4 size high quality paper "CF paper" (manufactured by Konica Minolta, Inc.), the image concentrations of these images were measured at five points by using a Macbeth image concentration meter "RD-918" (manufactured by Macbeth), and the unevennesses of the concentrations of the respective colors were calculated by using the measured values.

Differences in the unevennesses of concentration between the color toner of each color and the black toner were obtained, and the largest difference is shown as an image concentration unevenness (an image unevenness in the following Table 8) in the following Table 8. Furthermore, the images having the above-mentioned image concentration unevenness (the image unevenness in the following Table 8) of lower than 10% were deemed as acceptable.

The reason why image concentration unevennesses were evaluated under a high temperature-high humidity environment is that it can be deemed that the evaluation of image unevenness is fine under every environment as long as the evaluation of image unevenness is fine under a severe environment such as a high temperature-high humidity environment.

TABLE 7

| | Black Developer Lot | Yellow Developer Lot | Magenta Developer Lot | Cyan Developer Lot |
|---|---|---|---|---|
| Example 1 | Bk3 | Ye7 | Ma7 | Cy7 |
| Example 2 | Bk3 | Ye1 | Ma1 | Cy1 |
| Example 3 | Bk1 | Ye7 | Ma7 | Cy7 |
| Example 4 | Bk2 | Ye7 | Ma7 | Cy7 |
| Example 5 | Bk4 | Ye7 | Ma7 | Cy7 |
| Example 6 | Bk3 | Ye6 | Ma6 | Cy6 |
| Example 7 | Bk3 | Ye2 | Ma2 | Cy2 |
| Example 8 | Bk3 | Ye3 | Ma3 | Cy3 |
| Example 9 | Bk3 | Ye4 | Ma4 | Cy4 |
| Example 10 | Bk1 | Ye3 | Ma3 | Cy3 |
| Example 11 | Bk3 | Ye5 | Ma5 | Cy5 |
| Example 12 | Bk3 | Ye13 | Ma13 | Cy13 |
| Example 13 | Bk6 | Ye9 | Ma9 | Cy9 |
| Example 14 | Bk7 | Ye10 | Ma10 | Cy10 |
| Example 15 | Bk8 | Ye11 | Ma11 | Cy11 |
| Example 16 | Bk9 | Ye12 | Ma12 | Cy12 |
| Comparative Example 1 | Bk3 | Ye8 | Ma8 | Cy8 |
| Comparative Example 2 | Bk5 | Ye1 | Ma1 | Cy1 |
| Comparative Example 3 | Bk5 | Ye7 | Ma7 | Cy7 |

TABLE 8

| | Amount of Amorphous Polymerized Segment in Hybrid Crystalline Polyester Resin | | | | | Evaluation of Performances | |
|---|---|---|---|---|---|---|---|
| | Black Toner % by mass | Color Toner % by mass | Difference in Contents in Color and Black (% by mass) | Species of Amorphous Polymerized Segment in Hybrid Crystalline Polyester Resin | Amount of Hybrid Crystalline Polyester Resin % by mass | Lowest Fixing Temperature (° C.) | Image Unevenness |
| Example 1 | 0 | 25 | 25 | St-Ac | 9 | 143 | 9% |
| Example 2 | 0 | 1 | 1 | St-Ac | 9 | 143 | 7% |
| Example 3 | 1 | 25 | 24 | St-Ac | 9 | 144 | 9% |
| Example 4 | 2 | 25 | 23 | St-Ac | 9 | 142 | 8% |
| Example 5 | 10 | 25 | 15 | St-Ac | 9 | 148 | 6% |
| Example 6 | 0 | 20 | 20 | St-Ac | 9 | 140 | 7% |
| Example 7 | 0 | 2 | 2 | St-Ac | 9 | 140 | 8% |
| Example 8 | 0 | 3 | 3 | St-Ac | 9 | 136 | 5% |
| Example 9 | 0 | 6 | 6 | St-Ac | 9 | 136 | 1% |
| Example 10 | 1 | 3 | 2 | St-Ac | 9 | 137 | 7% |
| Example 11 | 0 | 10 | 10 | St-Ac | 9 | 138 | 2% |
| Example 12 | 0 | 10 | 10 | APES | 9 | 143 | 6% |
| Example 13 | 0 | 10 | 10 | St-Ac | 5 | 145 | 4% |
| Example 14 | 0 | 10 | 10 | St-Ac | 15 | 133 | 5% |
| Example 15 | 0 | 10 | 10 | St-Ac | 3 | 148 | 4% |
| Example 16 | 0 | 10 | 10 | St-Ac | 20 | 135 | 6% |
| Comparative Example 1 | 0 | 0 | 0 | St-Ac | 9 | 144 | 14% |
| Comparative Example 2 | 25 | 1 | −24 | St-Ac | 9 | 158 | 18% |
| Comparative Example 3 | 25 | 25 | 0 | St-Ac | 9 | 154 | 15% |

The amounts of the amorphous polymerized segment in the hybrid crystalline polyester resin (% by mass) in Table 8 are represented by separating into the amount of black toner (K) and the amount of color toners (YMC) other than the black toner used for the developers of the respective colors. The amorphous polymerized segment amount (% by mass) in the hybrid crystalline polyester resin contained in the color toners (YMC) other than the black toner was adjusted to be the same amount among the YMC toners. For example, in Example 1, the amount of the amorphous polymerized segment in the hybrid crystalline polyester resin contained in the color toners (YMC) other than the black toner is 25% by mass in either of the YMC toners.

Therefore, the difference in contents between color and black is a difference obtained by subtracting the amount of the amorphous polymerized segment in the hybrid crystalline polyester resin of the black toner (K) from the amount of the amorphous polymerized segment in the hybrid crystalline polyester resin of the color toner (YMC) other than the black toner (the same amount among YMC). In Comparative Example 2, the amount of the amorphous polymerized segment in the hybrid crystalline polyester resin in the black toner is greater than the amount of the amorphous polymerized segment in the hybrid crystalline polyester resin in the color toner other than the black toner (YMC) (the same amount among YMC), and thus the difference in contents between color and black is represented by minus (−).

Among the species of the amorphous polymerized segment in the hybrid crystalline polyester resin in Table 8, St-Ac is an abbreviation of a styrene-acrylic polymerized segment (an amorphous polymerized segment formed of a styrene-acrylic resin), and APES is an abbreviation of a crystalline polyester polymerized segment.

The amount of the hybrid crystalline polyester resin in Table 8 represents the amount of the crystalline polyester resin with respect to the total mass of the sum of the crystalline polyester resin, the amorphous resin, and the mold release agent in each color. In Examples 1 to 18 and Comparative Examples 1 to 3, as shown in Table 8, the toners of the respective colors (YMCK) were prepared so that the amount of the contained crystalline polyester resin is the same among YMCK. For example, in Example 1, the amount of the crystalline polyester resin contained in the toner of each color (YMCK) is 9% by mass in either of the YMCK toners.

From the results shown in the above-mentioned Table 8, in the color toner sets (the processes for forming an image) of Examples 1 to 16, the content of the amorphous polymerized segment in the hybrid crystalline polyester resin is greater in the contents in the toners containing a colorant having a high resistance other than the toner containing a colorant having the lowest resistance (color toners YMC) than in the content in the toner containing a colorant having the lowest resistance (black toner K). Therefore, it was able to be confirmed that the images formed by using the color toner sets (the processes for forming an image) of Examples 1 to 16 were able to suppress image concentration unevenness under a high temperature-high humidity environment while maintaining a fine low temperature fixing property to thereby provide a fine transfer performance.

On the other hand, in the color toner sets (the processes for forming an image) of Comparative Examples 1 to 3, the content of the amorphous polymerized segment in the hybrid crystalline polyester resin is such that the content (B) in the toners containing a colorant having a high resistance other than the toner containing a colorant having the lowest resistance (the color toners YMC) is smaller than the content (A) in the toner containing a colorant having the lowest resistance (the black toner K) (the difference in contents between color and black is minus), or the contents (B) and (A) are of the same amount. Therefore, it was shown that either of the low temperature fixing property and the image concentration unevenness under a high temperature-high humidity environment decreased in the images formed by using the color toner sets (the processes for forming an image) of Comparative Examples 1 to 3.

Although embodiments of the present invention have been described and illustrated in detail, the disclosed embodiments are made for purposes of illustration and example only and not limitation. The scope of the present invention should be interpreted by terms of the appended claims.

What is claimed is:

1. A color image forming process comprising:

forming an electrostatic latent image on a photosensitive body;

developing the electrostatic latent image with colorant-containing toners of multiple colors on the photosensitive body to form a toner image on the photosensitive body, the toners containing colorants respectively having different resistances;

transferring the toner image from the photosensitive body to an image substrate; and fixing the toner image on the image substrate with heat and pressure to form a color image on the image substrate, wherein each of the colorant-containing toners contains an amorphous resin, a crystalline polyester resin, and a mold release agent, at least the crystalline polyester resin contained in the colorant-containing toner other than the colorant-containing toner containing a colorant having the lowest resistance comprises a hybrid crystalline polyester resin formed by bonding a crystalline polyester polymerized segment and an amorphous polymerized segment, the amorphous polymerized segment being a styrene-acrylic polymerized segment, and the content of the amorphous polymerized segment in the hybrid crystalline polyester resin contained in the colorant-containing toner other than the colorant-containing toner containing a colorant having the lowest resistance is greater than the content of the amorphous polymerized segment in the crystalline polyester resin contained in the colorant-containing toner containing a colorant having the lowest resistance.

2. The color image forming process according to claim 1, wherein the colorant-containing toner containing a colorant having the lowest resistance is a black toner.

3. The color image forming process according to claim 1, wherein the colorant-containing toners other than the colorant-containing toner containing a colorant having the lowest resistance are a yellow toner, a magenta toner, and a cyan toner.

4. The color image forming process according to claim 1, wherein the content of the amorphous polymerized segment in the crystalline polyester resin contained in the colorant-containing toner containing a colorant having the lowest resistance is 0 to 1% by mass.

5. The color image forming process according to claim 1, wherein the content of the amorphous polymerized segment in the hybrid crystalline polyester resin contained in the colorant-containing toner other than the colorant-containing toner containing a colorant having the lowest resistance is 1 to 20% by mass.

6. The color image forming process according to claim 1, wherein the following Formula (1):

$$3 \leq (a-b) \leq 10 \quad \text{Formula (1)}$$

is satisfied, when the content of the amorphous polymerized segment in the hybrid crystalline polyester resin contained in the colorant-containing toner other than the colorant-containing toner containing a colorant having the lowest resistance is set as a (% by mass) and the content of the amorphous polymerized segment in the crystalline polyester resin contained in the colorant-containing toner containing a colorant having the lowest resistance is set as b (% by mass).

7. The color image forming process according to claim 1, wherein the content of the amorphous polymerized segment in the hybrid crystalline polyester resin contained in the colorant-containing toner other than the colorant-containing toner containing a colorant having the lowest resistance is 3 to 10% by mass.

8. The color image forming process according to claim 1, wherein the amorphous resin is a styrene-acrylic resin.

9. The color image forming process according to claim 1, wherein the content of the crystalline polyester resin in the colorant-containing toners is 5 to 15% by mass.

10. A color toner set comprising a yellow toner, a magenta toner, a cyan toner, and a black toner as colorant-containing toners having multiple colors containing colorants having respectively different resistances, wherein each of the toners contains an amorphous resin, a crystalline polyester resin, and a mold release agent, at least the crystalline polyester resin contained in each of the yellow toner, the magenta toner, and the cyan toner which are the colorant-containing toners other than the colorant-containing toner containing a colorant having the lowest resistance comprises a hybrid crystalline polyester resin formed by bonding a crystalline polyester polymerized segment and an amorphous polymerized segment, the amorphous polymerized segment being a styrene-acrylic polymerized segment, and the content of the amorphous polymerized segment in the hybrid crystalline polyester resin contained in each of the yellow toner, the magenta toner, and the cyan toner which are the colorant-containing toners other than the colorant-containing toner containing at least a colorant having the lowest resistance is greater than the content of the amorphous polymerized segment in the crystalline polyester resin contained in the black toner as the colorant-containing toner containing a colorant having the lowest resistance.

* * * * *